US007343658B2

(12) United States Patent
Minayoshi et al.

(10) Patent No.: US 7,343,658 B2
(45) Date of Patent: Mar. 18, 2008

(54) REINFORCEMENT MEMBER ARRANGEMENT JIG FOR CONCRETE ELECTRIC POLE

(75) Inventors: Hiroyasu Minayoshi, Kanagawa (JP); Masato Ushiroyama, Tokyo (JP); Hitoshi Shoji, Chiba (JP)

(73) Assignee: NTT Infrastructure Network Corporation (JP)

( * ) Notice: Subject to any disclaimer, the term of this patent is extended or adjusted under 35 U.S.C. 154(b) by 0 days.

(21) Appl. No.: 11/058,580

(22) Filed: Feb. 15, 2005

(65) Prior Publication Data

US 2005/0166534 A1 Aug. 4, 2005

Related U.S. Application Data

(62) Division of application No. 10/322,071, filed on Dec. 17, 2002, now Pat. No. 6,890,461.

(30) Foreign Application Priority Data

Feb. 15, 2002 (JP) ..... P2002-38252
May 7, 2002 (JP) ..... P2002-132022
Jul. 12, 2002 (JP) ..... P2002-204901

(51) Int. Cl.
*B25B 27/14* (2006.01)
*B23P 6/00* (2006.01)

(52) U.S. Cl. ..... 29/281.5; 29/271; 29/402.01; 29/402.09; 29/270; 269/37; 269/47; 269/901; 269/904; 428/12; 52/641

(58) Field of Classification Search ..... 29/281.5, 29/271, 270, 402.01, 402.09, 402.18; 428/12, 428/33; 269/37, 45, 47, 901, 904, 909; 52/634, 52/641

See application file for complete search history.

(56) References Cited

U.S. PATENT DOCUMENTS

| | | | | |
|---|---|---|---|---|
| 2,157,670 | A * | 5/1939 | Ono | 135/25.3 |
| 2,313,110 | A | 3/1943 | Wertz | |
| 2,751,669 | A * | 6/1956 | Crumpacker et al. | 29/281.3 |
| 3,170,232 | A * | 2/1965 | Craver | 29/271 |
| 3,330,021 | A * | 7/1967 | Jacobsen | 29/261 |
| 3,374,798 | A * | 3/1968 | Samuelson | 135/33.7 |
| 3,513,615 | A * | 5/1970 | Berry | 52/633 |
| 3,650,284 | A * | 3/1972 | Weber | 135/26 |
| 3,957,250 | A | 5/1976 | Murphy | |
| 4,028,709 | A * | 6/1977 | Berkowitz et al. | 343/819 |
| 4,069,832 | A * | 1/1978 | Bingham | 135/143 |
| 4,463,538 | A | 8/1984 | Dragunas | |

(Continued)

FOREIGN PATENT DOCUMENTS

EP 0 572 243 12/1993

(Continued)

*Primary Examiner*—Essama Omgba
(74) *Attorney, Agent, or Firm*—Kilpatrick Stockton LLP

(57) ABSTRACT

In a method of reinforcing an existing concrete electric pole having an annular side wall, an inner hollow portion provided therein and an opening portion formed to a position of the annular side wall to be penetrated therethrough, at least one of a predetermined amount of mortar, a predetermined amount of sand and a predetermined amount of gravel is injected into the inner hollow portion of the electric pole through the opening portion. A reinforcing member for reinforcing the electric pole is injected into the inner hollow portion of the electric pole through the opening portion.

9 Claims, 32 Drawing Sheets

U.S. PATENT DOCUMENTS

| | | | | | |
|---|---|---|---|---|---|
| 4,771,530 | A | | 9/1988 | Creedon | |
| 4,892,601 | A | | 1/1990 | Norwood | |
| 4,905,441 | A | | 3/1990 | Landers | |
| 4,921,555 | A | | 5/1990 | Skiff | |
| 5,043,033 | A | | 8/1991 | Fyfe | |
| 5,245,812 | A | | 9/1993 | Landers | |
| 5,296,187 | A | | 3/1994 | Hackman | |
| 5,321,875 | A | * | 6/1994 | Hoffman et al. | 29/271 |
| 5,326,410 | A | | 7/1994 | Boyles | |
| 5,416,964 | A | * | 5/1995 | Thomas | 29/271 |
| 5,450,700 | A | | 9/1995 | Hackman | |
| 5,487,251 | A | | 1/1996 | Tolliver et al. | |
| 5,542,229 | A | | 8/1996 | Saito et al. | |
| 5,607,527 | A | | 3/1997 | Isley, Jr. | |
| 5,613,664 | A | | 3/1997 | Svalbe | |
| 6,715,504 | B2 | * | 4/2004 | Chen | 135/27 |

FOREIGN PATENT DOCUMENTS

| | | | |
|---|---|---|---|
| JP | H05-141089 | A | 6/1993 |
| JP | H05-332032 | A | 12/1993 |
| JP | H07-279314 | A | 10/1995 |
| JP | 08-109745 | | 4/1996 |
| JP | 10-237825 | | 9/1998 |
| JP | 11-140823 | | 5/1999 |
| JP | 2000-282711 | A | 10/2000 |
| JP | 2000-299914 | A | 10/2000 |
| JP | 2000-336815 | | 12/2000 |
| JP | 2002-004416 | A | 1/2002 |
| JP | 2002-209316 | A | 7/2002 |
| JP | 2002-357018 | | 12/2002 |
| JP | 2003-018732 | | 1/2003 |
| JP | 2003-166352 | | 6/2003 |
| WO | WO 93/04250 | | 3/1993 |

* cited by examiner

REINFORCEMENT MEMBER ARRANGEMENT JIG FOR CONCRETE ELECTRIC POLE

CROSS-REFERENCE TO RELATED APPLICATION

This application is a divisional application of application Ser. No. 10/322,071 filed Dec. 17, 2002 now U.S. Pat. No. 6,890,461.

BACKGROUND OF THE INVENTION

1. Field of the Invention

The present invention relates to an existing concrete electric pole, a jig for arranging a reinforcement member in the existing concrete electric pole and a method of reinforcing the existing concrete electric pole.

2. Description of the Related Art

An existing concrete electric pole is already installed so that its lower portion is arranged under the ground and its upper portion is arranged above the ground.

In cases of reinforcing the existing concrete electric pole for dealing with the aging change thereof and so on, there is adopted a conventional reinforcing method of winding a reinforcement member such as an aramid fiber seat or the like around an outer periphery of the concrete electric pole.

The electric concrete pole is usually reinforced in the range of its underground lower portion including its boundary portion with respect to the surface of the ground to its upper portion.

That is, when reinforcing the concrete electric pole by using the conventional reinforcing method, it is necessary to excavate the surface of the ground around the boundary portion of the concrete electric pole so as to expose the underground lower portion of the concrete electric pole.

Depending on the installed location of the concrete electric pole, structures which are adjacent to the concrete electric pole must be removed. For example, in a case where a wall around a house is close to the concrete electric pole, the wall must be removed. In addition, in a case where the surface of the ground around the boundary portion of the concrete electric pole is inclined and a stone wall or the like stands on the inclined surface in which the concrete electric pole is installed must be demolished.

The demolition works of the structures and the restoration works of new structures in place of the demolished structures require much time, causing the total time of the reinforcing work and the total cost thereof to be increased, respectively.

SUMMARY OF THE INVENTION

The present invention is made on the background of the foregoing circumstances. Accordingly, it is an object of the present invention to provide a concrete electric pole, a reinforcement member arrangement jig in the concrete electric pole and a method of reinforcing the concrete pole, which are capable of easily reinforcing the concrete electric pole as compared with the conventional reinforcing method.

According to one aspect of the present invention based on the object, there is provided a method of reinforcing an existing concrete electric pole having an annular side wall, an inner hollow portion provided therein and an opening portion formed to a position of the annular side wall to be penetrated therethrough, the method comprising the steps of: injecting at least one of a predetermined amount of mortar, a predetermined amount of sand and a predetermined amount of gravel into the inner hollow portion of the electric pole through the opening portion; and injecting a reinforcing member for reinforcing the electric pole into the inner hollow portion of the electric pole through the opening portion.

According to another aspect of the present invention based on the object, there is provided a method of reinforcing an existing concrete electric pole having an annular side wall, an inner hollow portion provided therein and an opening portion formed to a position of the annular side wall to be communicated to the inner hollow portion, the method comprising the steps of: injecting at least one of a predetermined amount of mortar, a predetermined amount of sand and a predetermined amount of gravel into the inner hollow portion of the electric pole through the opening portion; inserting a reinforcing member for reinforcing the electric pole into the inner hollow portion of the electric pole through the opening portion; and injecting filling material into a gap between the inserted reinforcing member and the inner hollow portion.

According to further aspect of the present invention based on the object, there is provided a method of reinforcing an existing concrete electric pole having an annular side wall, an inner hollow portion provided therein and an opening portion formed to a position of the annular side wall to be penetrated therethrough, the method comprising the steps of: preparing a jig member; inserting a reinforcing member for reinforcing the electric pole into the inner hollow portion of the electric pole through the opening portion while the reinforcing member is supported by the jig member; injecting at least one of a predetermined amount of mortar, a predetermined amount of sand and a predetermined amount of gravel into the inner hollow portion of the electric pole through the opening portion; and while the inserted reinforcing member is supported by the jig member, injecting filling material into a gap between the inserted and supported reinforcing member and the inner hollow portion.

According to still further aspect of the present invention based on the object, there is provided a reinforced electric concrete pole reinforced by the method according to one aspect of the present invention.

According to still further aspect of the present invention based on the object, there is provided a reinforced electric concrete pole reinforced by the method according to second aspect of the present invention.

According to still further aspect of the present invention based on the object, there is provided a reinforced electric concrete pole reinforced by the method according to third aspect of the present invention.

According to still further aspect of the present invention based on the object, there is provided a jig for arranging a plurality of reinforcing members in an inner hollow portion of an existing concrete electric pole, each of the plurality of reinforcing members has one end portion to which a string member is connected, the jig comprising: a base portion; a plurality of supporting members rotatably mounted on one end portion of the base portion, the supporting members have a substantially rod shape and same longitudinal lengths, respectively; a plurality of through holes formed on both end portions of the supporting members, respectively, each of the through holes allowing each of the string members to be put therethrough; and a locking member mounted on the base portion, the locking member for releasable locking the supporting members.

According to still further aspect of the present invention based on the object, there is provided a jig for arranging a plurality of reinforcing members in an inner hollow portion of an existing concrete electric pole, each of the plurality of reinforcing members has one end portion to which a string member is connected, the jig comprising: a base bar; a supporting member mounted on one end portion of the base bar, the supporting member having a surface of substantially circular arc shape; and a plurality of suspending members mounted on the surface of the supporting member, each of the suspending members having a through hole allowing the string member to be put therethrough.

According to still further aspect of the present invention based on the object, there is provided a method of arranging a plurality of reinforcing members in an inner hollow portion of an existing concrete electric pole by using the jig, each of the plurality of reinforcing members being inserted in the inner hollow portion and having one end portion to which a string member is connected, the method comprising the steps of: connecting other end portions of the string members to the through holes of the jig, respectively, inserting the supporting members into the inner hollow portion through the opening portion; rotating the supporting members so that, when the plurality of supporting members are arranged at same intervals among them in the rotational direction, the supporting members are releasable locked by the locking member of the jig; and pulling the other end portions of the string members to be tensioned so that the reinforcing members are arranged in the inner hollow portion at same intervals thereamong in the rotational direction.

According to still further aspect of the present invention based on the object, there is provided a method of arranging a plurality of reinforcing members in an inner hollow portion of an existing concrete electric pole by using the jig, each of the plurality of reinforcing members being inserted in the inner hollow portion and having one end portion to which a string member is connected, the method comprising the steps of: connecting other end portions of the string members to the through holes of the jig, respectively, inserting the supporting member into the inner hollow portion through the opening portion; handling the jig so as to arrange an axial direction of each of through holes is substantially parallel to the axial direction of the electric pole; and pulling the other end portions of the string members to be tensioned so that the reinforcing members are arranged in the inner hollow portion at same intervals thereamong in a circumferential direction.

BRIEF DESCRIPTION OF THE DRAWINGS

Other objects and aspects of the present invention will become apparent from the following description of embodiments with reference to the accompanying drawings in which.

DETAILED DESCRIPTION OF EMBODIMENTS

Embodiments of the present invention will be described hereinafter with accompanying drawings.

First Embodiment

A first embodiment of the present invention will be described hereinafter with reference to FIGS. 1 to 3.

A method of reinforcing an existing concrete electric pole, referred to simply as "electric pole", according to the first embodiment has a step of injecting a reinforcing member in the electric pole through its injection hole portion such as an earth hole or the like previously formed to a predetermined position of a side wall of the electric pole above the surface of the ground therearound.

This method according to the first embodiment is mainly adopted when reinforcing a part of the electric pole adjacent to the boundary portion thereof under the earth hole.

Figure 1:
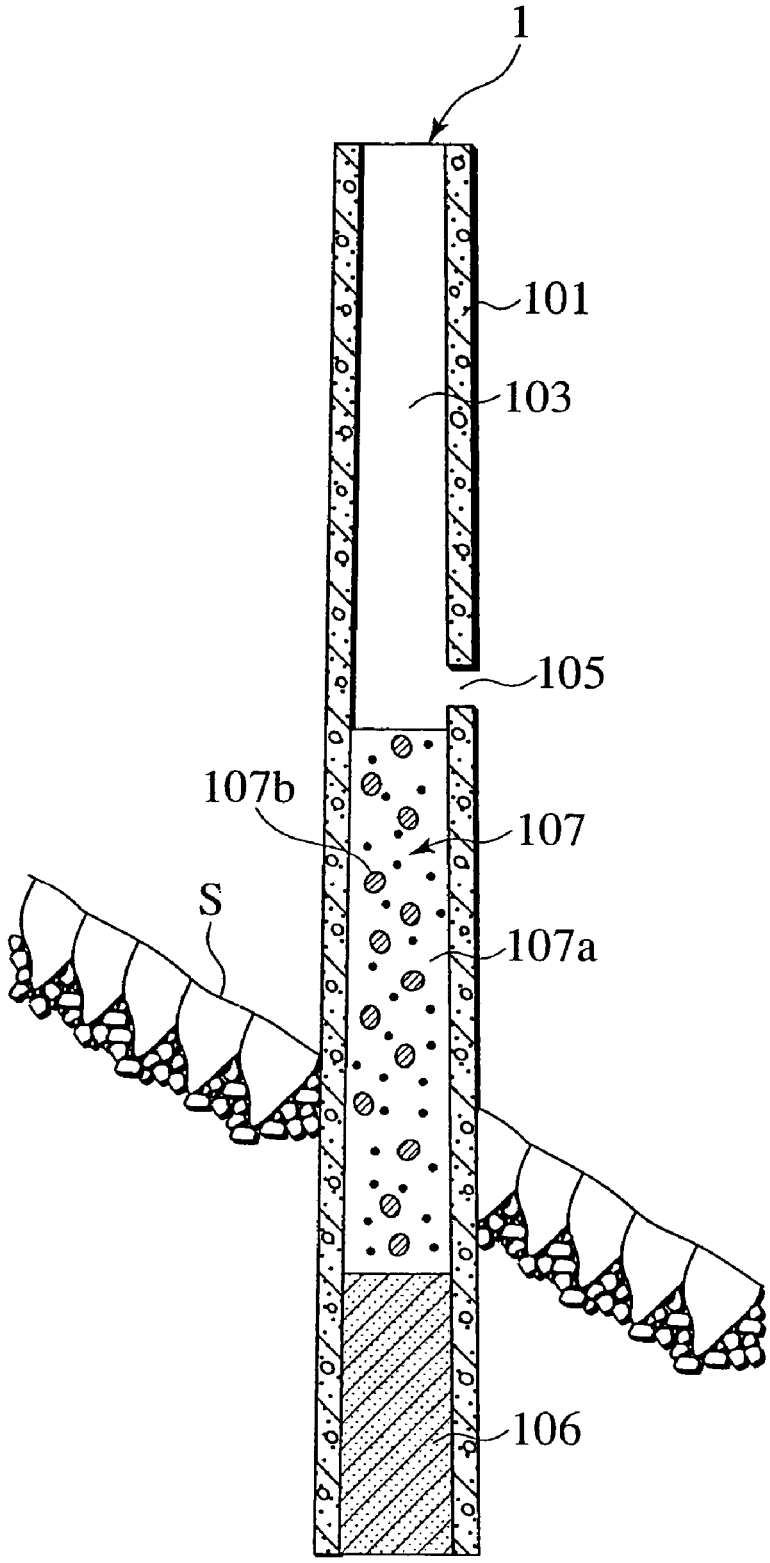
FIG. 1 is a partially longitudinal cross sectional view showing a structure of an electric pole which is already reinforced by a reinforcing method according to a first embodiment of the present invention.

FIG. 1 is a partially longitudinal cross sectional view showing a structure of an electric pole 1 which is already reinforced by the reinforcing method according to the first embodiment.

As shown in FIG. 1, the reinforced electric pole 1 is installed under the ground so as to stand the surface S thereof and has a substantially tubular shape to be gradually tapered toward its top portion.

In the first embodiment, the surface S of the ground is reinforced with blocks or the like so as to be inclined in order to prevent a landslide of the ground from occurring.

The reinforced electric pole 1 is provided with an annular side wall 101 composed of reinforced concrete and an inner hollow portion 103 provided inside of the annular side wall 101.

The reinforced electric pole 1 is formed with an earth hole 105 previously penetrated through a predetermined position of the annular side wall 101 of the electric pole 1 above the surface S of the ground therearound.

The reinforced electric pole 1 is provided with a mortar-filled portion (mortar-filled layer) 106 which is located under the ground and is formed with a predetermined amount of mortar injected from the earth hole 105 to be filled in the inner hollow portion 103 of the lower portion of the pole 1 under the ground.

A top portion of the mortar-filled portion 106 is positioned to a substantially from 400 mm to 800 mm below the surface S of the ground and served as a base of a reinforcing portion described hereinafter.

The reinforced electric pole 1 is also provided with the reinforcing portion (reinforcing layer) 107 formed with reinforcing member injected from the earth hole 105 to be filled in the inner hollow portion 103 on the mortar-filled portion 106 of the pole 1 up to the vicinity of the earth hole 105.

The earth hole portion 105 from which the mortar and the reinforcing member are injected has a substantially elliptical shape. The earth hole portion 105 has a major axis of substantially from 40 to 60 mm, and a minor axis of substantially from 20 to 40 mm.

The predetermined position of the annular side wall 101 to which the earth hole portion 105 is provided is usually located at a height ranging from substantially 1200 mm to substantially 1600 mm with respect to the surface S of the ground.

As the reinforcing member constituting the reinforcing portion 107, a mixture is used, which is composed of hardened resin such as epoxy resin and aggregates such as gray irons. The mixture is formed by mixing the hardened resin with the aggregates so that the strength of the mixture is more increased.

Figure 2:
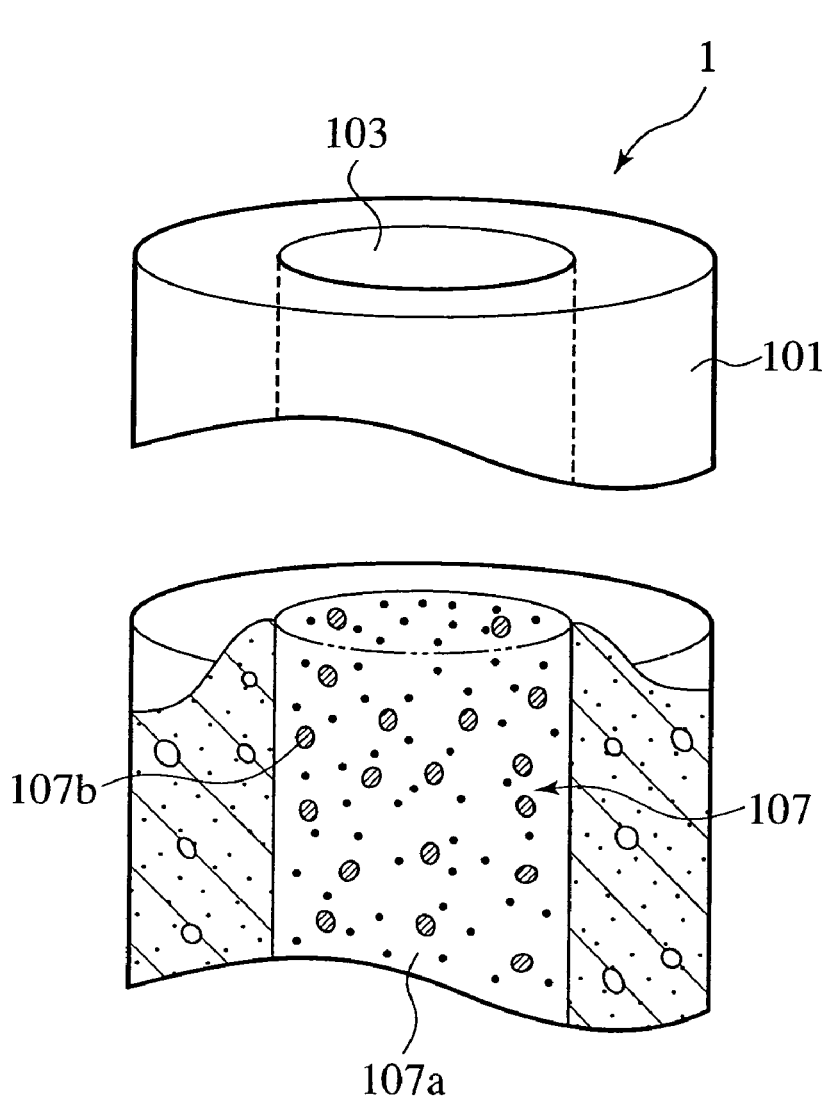
FIG. 2 is an enlarged perspective cross sectional view showing a detailed structure of the reinforcing portion of the electric pole shown in FIG. 1.

In FIGS. 1 and 2, the reference numeral 107*a* shows the resin corresponding to the area including black points in FIGS. 1 and 2, and the reference numeral 107*b* shows the gray irons corresponding to the shadow areas therein.

Incidentally, the reinforcing member according to the first embodiment is not limited to the mixture. That is, for example, concrete may be used for the resin 107*a*, and/or single chains composed of aramid may be used for the gray irons.

As the reinforcing member, unshrinkable mortar which is not shrinkable even if it is solidified is may be used.

On the other hand, it may be possible to fill a predetermined amount of pieces of sand and/or a predetermined amount of pieces of gravel in the inner hollow portion 103 of the electric pole 1 to form the mortar-filled portion in place of filling the mortar therein.

Figure 3A:
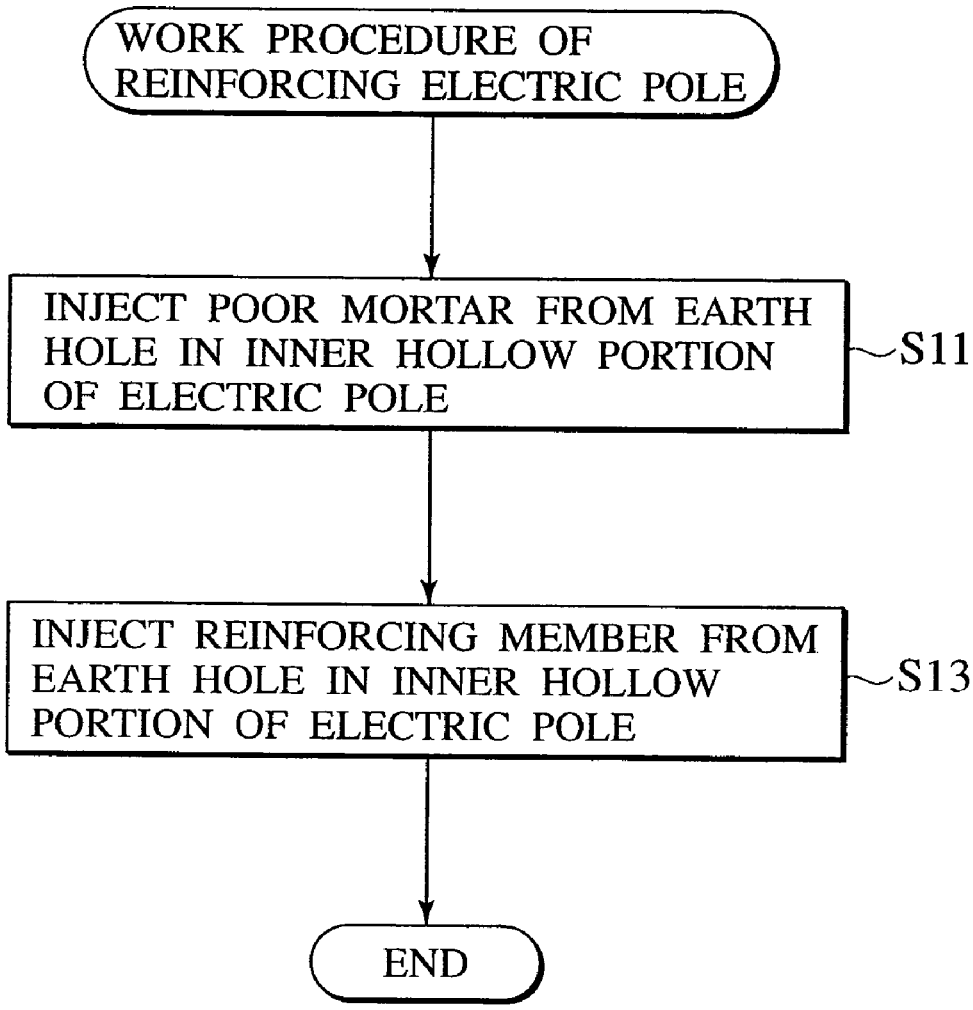
FIG. 3A is a flowchart showing a working procedure of reinforcing an electric pole which has not been reinforced yet according to the first embodiment.
Figure 3B:
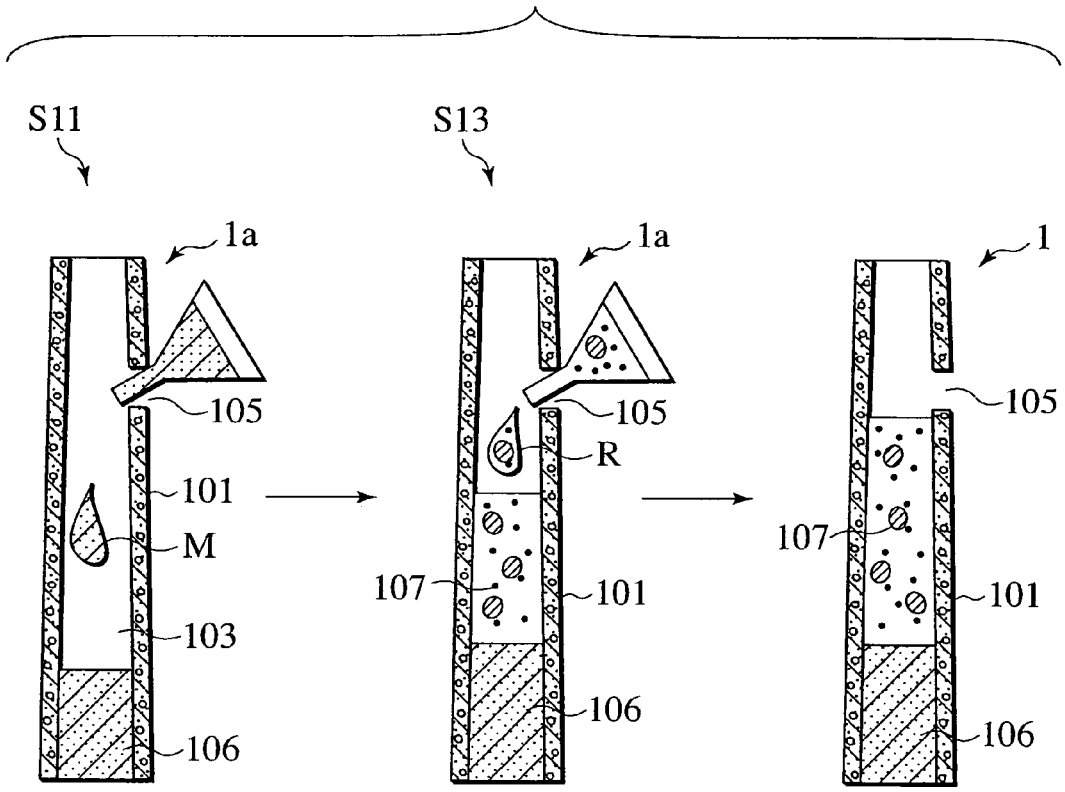
FIG. 3B is a view pictorially showing the working procedure shown in FIG. 3A.

FIG. 3A is a flowchart showing a working procedure of reinforcing the electric pole 1*a* which has not been reinforced yet according to the first embodiment. FIG. 3B pictorially shows the working procedure shown in FIG. 3A.

The reinforcing work according to the first embodiment will be described hereinafter with reference to FIGS. 3A and 3B.

At first, a predetermined amount of poor mortar M which is served as a base of the reinforcing portion 107 is injected from the earth hole 105 to be filled in the inner hollow portion 103 of the lower portion of the pole 1*a* under the ground, forming the mortar-filled portion 105 therein (step S1).

The amount of injecting mortar varies in accordance with the conditions of the electric pole 1*a* including the capacity thereof and so on so that, in the first embodiment, the amount of injecting mortar is adjusted so that the top portion of the mortar-filled portion 106 is positioned to a substantially from 400 mm to 800 mm below the surface S of the ground.

Next, the reinforcing member R composed of the mixture of the resin 107*a* and the gray irons 107*b* is injected from the earth hole 105 to be filled in the inner hollow portion 103 on the mortar-filled portion 106 of the electric pole 1*a* up to the vicinity of the earth hole 105 (step S13).

In this first embodiment, in step S13, because the earth hole portion 105 is located to the predetermined position of the annular side wall 101 at the height ranging from substantially 1200 mm to substantially 1600 mm with respect to the surface S of the ground, the injecting works are carried out through the earth hole portion 105.

However, in step S13, the injection works may be carried out through another hole portion formed to a predetermined position of the annular side wall 101 to be penetrated therethrough, predetermined position which is adjacent to at least one of the scaffold volts mounted on the annular side wall 101.

The described procedure of the reinforcing work is carried out in accordance with the described procedure shown in FIG. 3 so that the reinforced electric pole 1 shown in FIGS. 1 and 2 is accomplished.

After carrying out the work shown in step S13, in cases where it can be accepted to reinforce the reinforced electric pole 1 from the outer periphery thereof after sufficient consideration of constrains due to the installation requirements of the electric pole 1 and the reinforcing cost thereof, it may be possible to wind a seat member such as an aramid fiber seat or the like around an outer periphery of a portion of the annular side wall 101, portion which ranges from the boundary portion of the electric pole 1 to the hole portion 103.

As described in step S13, in cases where no earth hole 105 is provided or a portion of the electric pole 1 which is higher than the earth hole 105 is to be reinforced, at least one of the scaffold volts mounted on a predetermined position of the annular side wall 101 is removed therefrom so that a hole portion is formed on the removed position with a drill or other similar devices so as to be communicated to the inner hollow portion 103. The formed hole portion allows the mortar and the reinforcing member to be injected into the inner hollow portion 103, making it possible to carry out the above reinforcing method according to the first embodiment.

As described above, according to the first embodiment of the present invention, it is possible to simply reinforce a portion of the electric pole 1 the earth hole 105 of which is located higher than the potion of the electric pole 1 to be reinforced.

In addition, the mortar and the gray irons are not only cheaper than an aramid fiber seat used for the conventional reinforcing method but also have no need of excavating the surface S of the ground around the boundary portion of the electric pole, and of carrying out demolition and restoration works therearound, making it possible to reduce the cost of the reinforcing work of the electric pole.

In the first embodiment, even in cases where the electric pole is installed on a special location at which it seems extremely hard to reinforce the electric pole, such as a location close to at least one of structures such as a house, or a location with a surface of the ground which is reinforced with blocks or the like so as to be inclined in order to prevent a landslide of the ground from occurring as shown in FIG. 1, using the reinforcing method according to the first embodiment allows the reinforcing work to be easily carried out, obtaining especially considerable effects when the electric pole installed on such a special location.

Incidentally, applicants performed experiments in checking the strength of the reinforced electric pole reinforced by the reinforcing method according to the first embodiment so that it was demonstrated that the reinforced electric pole reinforced by the reinforcing method according to the first embodiment had substantially the same strength of a conventional reinforced pole reinforced by the conventional reinforcing method or more strength than the strength of the conventional reinforced pole. Concretely, when reinforcing the electric pole with one part of its annular side wall being cut, one part which corresponds to a substantially 30 to 50% of the whole annular side wall, a checked strength that satisfies the designed strength usually required for an electric pole was obtained.

Second Embodiment

A second embodiment of the present invention will be described hereinafter with reference to FIGS. 4 to 6.

A method of reinforcing an electric pole according to the second embodiment has a step of removing a cover composed of concrete and fitted in a top opening portion of an annular side wall, and injecting a reinforcing member in the electric pole through the top opening portion of the annular side wall so as to reinforce the electric pole.

Figure 4:
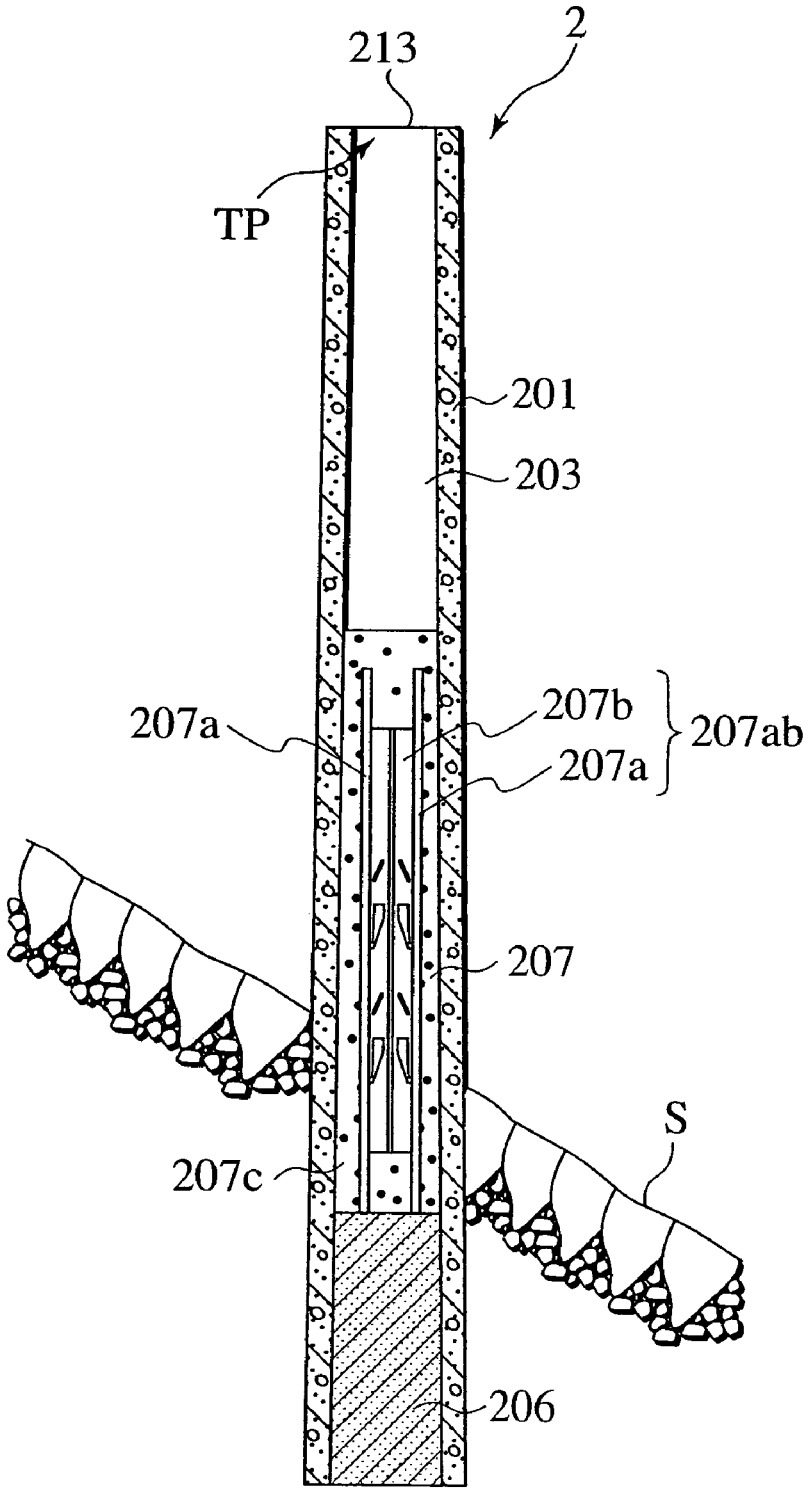
FIG. 4 is a partially longitudinal cross sectional view showing a structure of an electric pole which is already reinforced by a reinforcing method according to a second embodiment of the present invention.

This reinforcing method can be applied to reinforcing a middle portion of the electric pole in accordance with the aging change thereof due to transformers mounted on the upper portion of the electric pole and/or cables installed between the electric pole and another electric poles. structure of an electric pole 2 which is already reinforced by the FIG. 4 is a partially longitudinal cross sectional view showing a reinforcing method according to the second embodiment.

As shown in FIG. 4, the reinforced electric pole 2 is installed under the ground so as to stand the surface S thereof and has a substantially tubular shape to be gradually tapered toward its top portion, similar to the first embodiment.

The reinforced electric pole 2 is provided with an annular side wall 201 composed of reinforced concrete and an inner hollow portion 203 provided inside of the annular side wall 201.

The annular side wall 201 is formed at its top portion with a top opening portion TP communicated to the inner hollow portion 203.

The reinforced electric pole 2 is provided with a mortar-filled portion 206 which is located under the ground and is formed with a predetermined amount of mortar injected from the top opening portion TP to be filled in the inner hollow portion 203 of the lower portion of the pole 2 under the ground.

A top portion of the mortar-filled portion 206 is positioned to, for example, a substantially from 400 mm to 800 mm below the surface S of the ground and served as a base of a reinforcing portion described hereinafter.

The reinforced electric pole 2 is also provided with the reinforcing portion 207 provided in the inner hollow portion 203 of the electric pole 2 on the mortar-filled portion 206 thereof.

Figure 5:
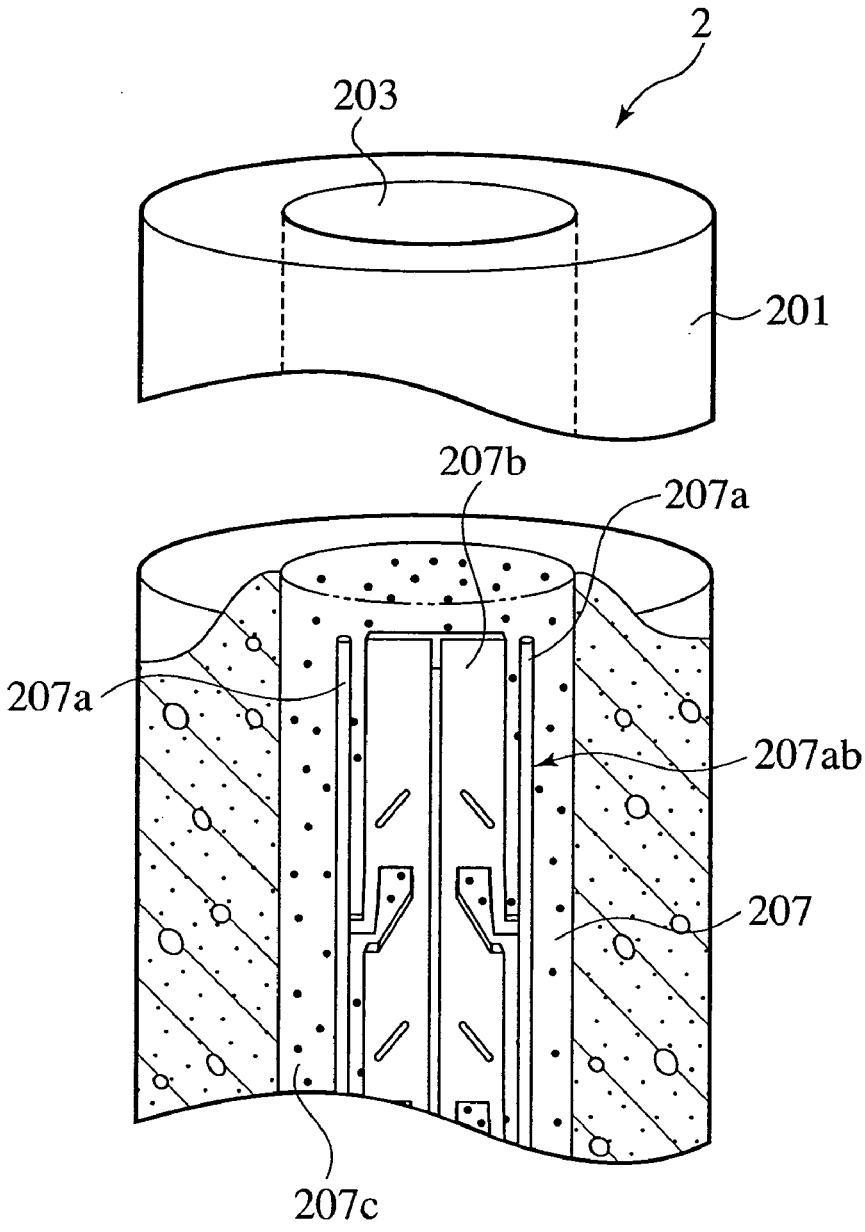
FIG. 5 is an enlarged perspective cross sectional view showing a detailed structure of the reinforcing portion of the electric pole shown in FIG. 4.

As shown in FIGS. 4 and 5, the reinforcing portion 207 is formed with a reinforcing member 207*ab* mounted on the mortar-filled portion 206 and filling material 207*c* filled in a gap between the reinforcing member 207*ab* and the inner hollow portion 203 so that the reinforcing member 207*ab* is arranged substantially in the longitudinal direction (axial direction) of the electric pole 2.

The reinforcing member 207*ab* comprises a plurality of aramid rods 207*a* mounted on the top portion of the mortar-filled portion 206 and a fixing member 207*b* mounted on the mortar-filled portion 206 by which the plurality of aramid rods are fixed to be assembled.

Each of the aramid rods 207*a* has a substantially 15 to 25 mm in diameter, and preferably, has a substantially 15 to 20 mm in diameter.

Furthermore, the electric pole 2 is provided with a cover 213 composed of concrete and fitted in the top opening portion TP of the annular side wall 201.

In FIG. 5, only two aramid rods 207*a* are shown in order to avoid FIG. 5 becomes more complicated, but, approximately six to ten aramid rods 207*a* are usually fixed to the fixing member 207*b*. The number of aramid rods 207*a* fixed to the fixing member 207*b* are determined depending on a diameter (bore diameter) of the inner hollow portion 203, the degree required for reinforcement and the like.

The longitudinal length of the reinforcing member 207*ab* is accordingly adjusted depending on the requirements of a portion of the electric pole 2 to be reinforced. For example, when reinforcing both of the boundary portion with respect to the surface S and the middle portion of the electric pole 2, the longitudinal length of the reinforcing member 207*ab* is adjusted so that, in a state that the reinforcing member 207*ab* is inserted in the inner hollow portion 203 and mounted on the mortar-filled portion 206, the top portion of the reinforcing member 207*ab* is reached up to the height adjacent to the position at which cables are installed, height which is substantially 3800 mm to 5500 mm from the boundary portion of the electric pole 2. After the length of the reinforcing member is adjusted, the adjusted reinforcing member may be inserted from the top opening portion TP of the annular side wall 201 into the inner hollow portion 203.

Incidentally, the reinforcing member is not limited to the structure shown in FIG. 5.

Figure 6:
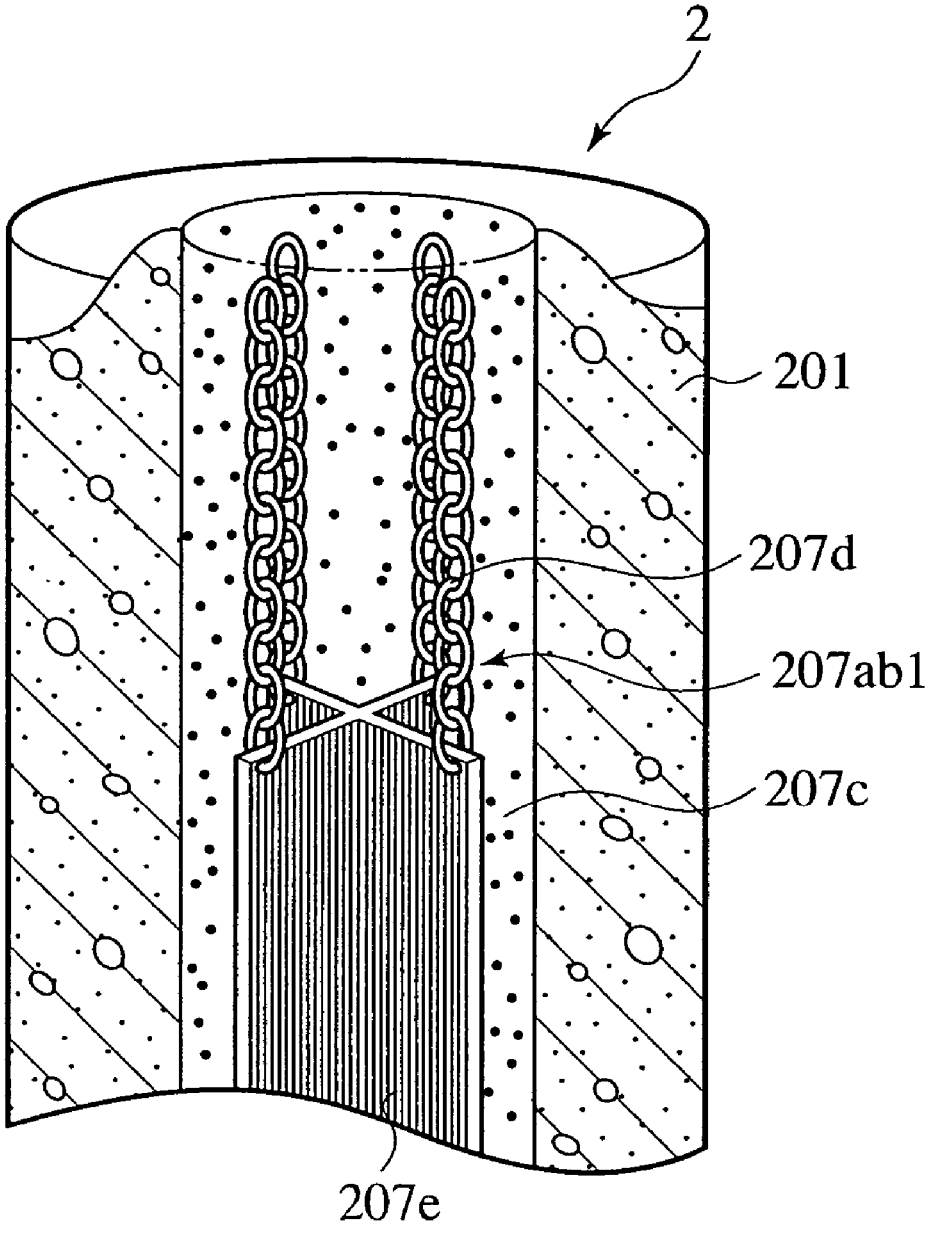
FIG. 6 is an enlarged perspective cross sectional view showing a modification of an electric pole according to the second embodiment.

That is, as shown in FIG. 6, the reinforcing member 207*ab*1 comprises an aluminum plate 207*e* mounted on the top portion of the mortar-filled portion 206 and a plurality of aramid chains 207*d* composed of aramid fiber and joined to the aluminum plate 207*e*. In this case, the longitudinal length of the aluminum plate 207*e* and that of each of the aramid chains 207*d* are adjusted so that the aluminum plate 207*e* is located to the inside of the middle portion to which reinforcement is mostly required. In FIG. 6, a vinyl plate with both surfaces on which aramid fiber seats are affixed may be used in place of the aluminum plate 207*e*.

Unshrinkable mortar which, while the unshrinkable mortar is filled in the gap between the reinforcing member 207*ab* and the inner hollow portion 203, allows its strength to be increased and is not shrinkable even if it is solidified may be used as the filling material 207*c*. Moreover, resin such as epoxy, concrete or other similar material may be used as the filling material 207*c*.

The amount of injecting mortar is adjusted in a similar manner to the first embodiment. Moreover, similarly to the first embodiment, a predetermined amount of pieces of sand and/or a predetermined amount of pieces of gravel may be injected in the inner hollow portion 203 of the electric pole 2 in place of the predetermined amount of mortar.

Figure 7A:
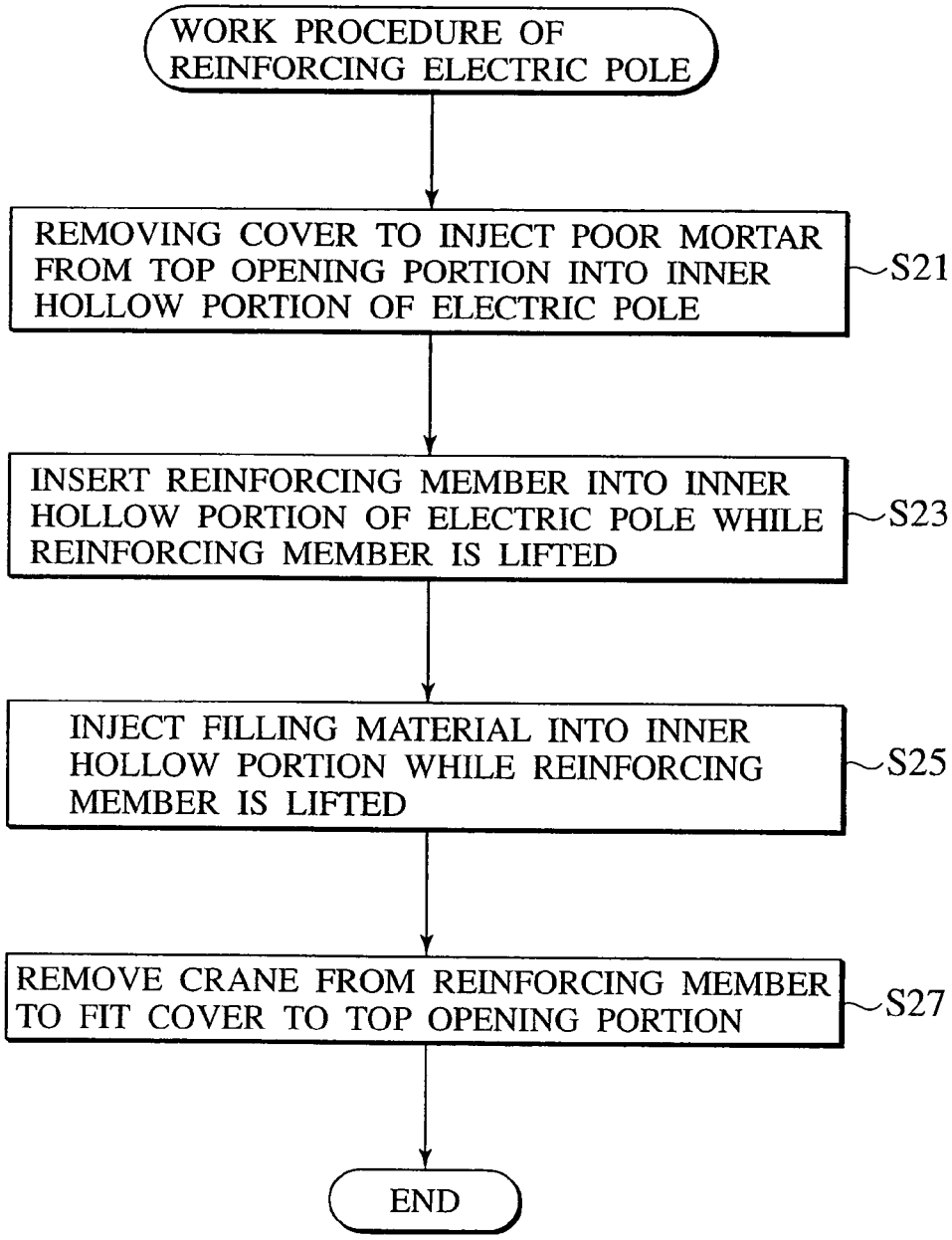
FIG. 7A is a flowchart showing a working procedure of reinforcing an electric pole which has not been reinforced yet according to the second embodiment.
Figure 7B:
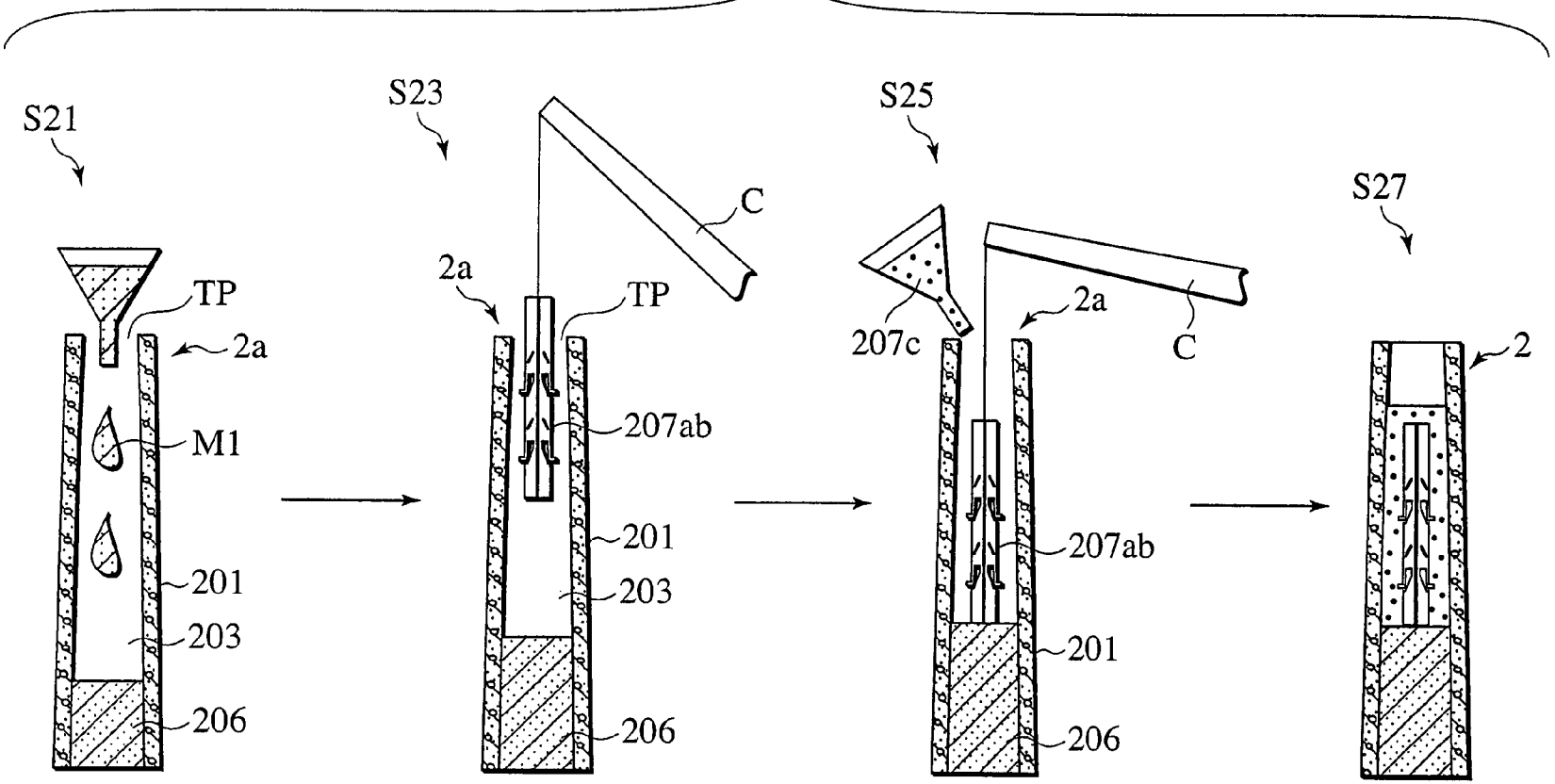
FIG. 7B is a view pictorially showing the working procedure shown in FIG. 7A.

FIG. 7A is a flowchart showing a working procedure of reinforcing the electric pole 2*a* which has not been reinforced yet according to the second embodiment. FIG. 7B pictorially shows the working procedure shown in FIG. 7A.

At first, the cover 213 is removed from the top opening portion TP of the electric pole 2*a*, and a predetermined amount of poor mortar M1 which is served as a base of the reinforcing portion 207 is injected from the top opening portion TP to be filled in the inner hollow portion 203 of the lower portion of the pole 2*a* under the ground, forming the mortar-filled portion 205 therein (step S21).

Next, the reinforcing member 207*ab* which is previously assembled in such a manner that the plurality of aramid rods 207*a* are fixed to the fixing member 207*b* is lifted up with a crane C or the like so that the reinforcing member 207*ab* is inserted from the top opening portion TP into the inner hollow portion 203 (step S23).

After carrying out the work in step S23, while the reinforcing member 207*ab* is lifted up by the crane C, the filling material 207*c* is injected from the top opening portion TP into the inner hollow portion 203 up to the height adjacent to the top portion of the reinforcing member 207*ab*, causing the middle portion of the electric pole 2*a* in which the reinforcing member 207*ab* is inserted to be reinforced (step S25).

Finally, the crane C is removed from the reinforcing member 207*ab* so that the cover 213 is fitted to the top opening portion TP of the electric pole 2*a* so that the reinforcing work is finished (step S27).

The reinforcing work is carried out in accordance with the described procedure shown in FIG. 7 so that the reinforced electric pole 2 shown in FIGS. 4 and 5 is accomplished.

Incidentally, after carrying out the work in step S27, in cases where it can be accepted to reinforce the reinforced electric pole 2 from the outer periphery thereof after sufficient consideration of constrains due to the installation requirements of the electric pole 2 and the reinforcing cost thereof, it may be possible to wind a seat member such as an aramid fiber seat or the like around an outer periphery of the annular side wall 201. In particular, a seat member such as an aramid fiber may be wound around only an outer periphery of a portion of the annular side wall 201, portion which ranges from the boundary portion of the electric pole 2 to the vicinity of the top portion of the reinforcing portion 207.

The second embodiment of the present invention properly can obtain the same effects of the first embodiment.

When reinforcing a middle portion of the electric pole or an upper portion of the electric pole with respect to the earth hole in addition to the boundary portion thereof, using the reinforcing method according to the second embodiment allows the reinforcing work to be easily carried out, obtaining especially considerable effects.

Third Embodiment

A third embodiment of the present invention will be described hereinafter with reference to FIGS. 8 to 17.

A method of reinforcing an electric pole according to the third embodiment has a step of forming at least two opening portions (a first opening portion and a second opening portion) in an annular side wall of the electric pole, a step of injecting material for base such as pieces of mortar, pieces of sand or pieces of gravel from the first opening portion for forming a base for reinforcement into an inside of the annular side wall and a step of inserting a plurality of rod members each composed of aramid, which is referred to as "aramid rod", from the second opening portion into the inside of the annular side wall.

In this third embodiment, the plurality of aramid rods as reinforcing members are inserted in the inside of the annular side wall of the electric pole. A string member is connected to each of the aramid rods. Each string member connected to each aramid rod is connected through each through hole of a jig for arranging each aramid rod in the inside of the annular side wall of the electric pole.

Handling the jig allows the plurality of aramid rods to be arranged in the inner hollow portion at regular intervals thereamong.

Each of the aramid rods has a substantially 15 to 25 mm in diameter, and preferably, has a substantially 15 to 20 mm in diameter.

As the string member connected to the aramid rod, a linear string, a stainless wire or the like is used, and the string member has a substantially 1 to 3 mm in diameter, and preferably, has a substantially 1.5 mm in diameter.

The string member can be wound around an outer periphery of an upper portion of the aramid rod to be connected thereto, described hereinafter, or the string member can be fixed with a screw or the like to the outer periphery of the upper portion of the aramid rod to be connected thereto.

Figure 8:
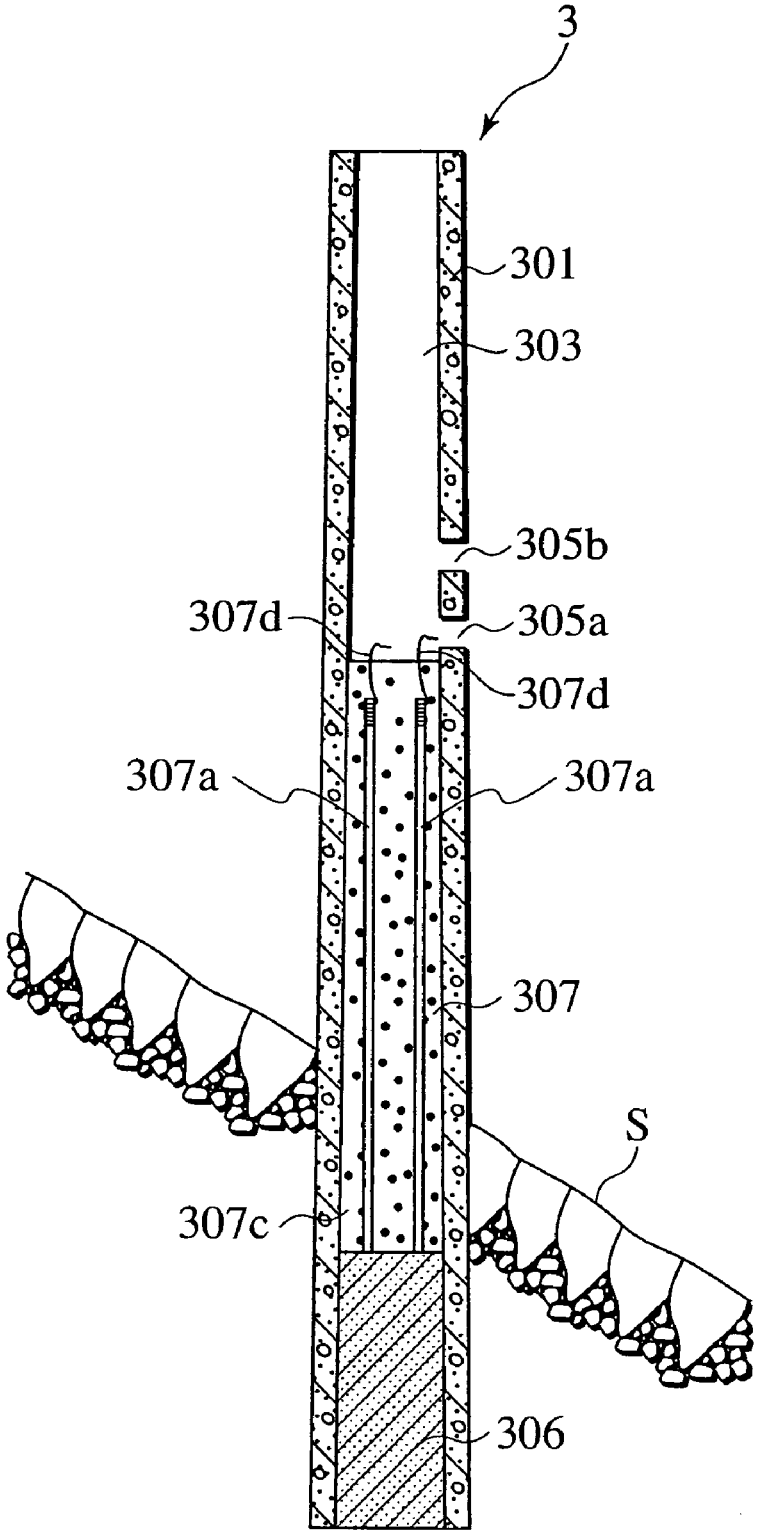
FIG. 8 is a partially longitudinal cross sectional view showing a structure of an electric pole which is already reinforced by a reinforcing method according to a third embodiment of the present invention.

FIG. 8 is a partially longitudinal cross sectional view showing a structure of an electric pole 3 which is already reinforced by the reinforcing method according to the third embodiment.

As shown in FIG. 8, the reinforced electric pole 3 is installed under the ground so as to stand the surface S thereof and has a substantially tubular shape to be gradually tapered toward its top portion, similar to the first and second embodiments.

The reinforced electric pole 3 is provided with an annular side wall 301 composed of reinforced concrete and an inner hollow portion 303 provided inside of the annular side wall 301.

The reinforced electric pole 3 is formed with a first opening portion 305*a* and a second opening portion 305*b* penetrated through predetermined first and second positions of the annular side wall 301 of the electric pole 3 above the surface S of the ground.

In FIG. 8, the first position and the second position are axially arranged, but the present invention is not limited to the structure so that the first and second opening portions may be located to desired portions of the annular side wall above the surface S of the ground.

The reinforced electric pole 3 is provided with a base portion 306 which is located under the ground and is formed with base members, such as a predetermined amount of mortar, a predetermined amount of pieces of sand or predetermined amount of pieces of gravel injected from the first opening portion 305*a* to be filled in the inner hollow portion 303 of the lower portion of the pole 3 under the ground.

A top portion of the base portion 306 is positioned to, for example, a substantially from 400 mm to 800 mm below the surface S of the ground and served as a base of a reinforcing portion described hereinafter.

An earth hole, or a hole portion formed to a predetermined position of the annular side wall 301 to which at least one of the scaffold volts is removed may be used as at least one of the first and second opening portions 305*a* and 305*b*, and in cases where no hole portions are formed to suitable portions of the annular side wall 301, the first and second opening portions may be formed with a core sampling drill or the like.

The first position to which the first opening portion 305*a* is formed is located at a height ranging from substantially 1000 mm to substantially 1200 mm with respect to the surface S of the ground, and the second position to which the second opening portion 305*b* is formed is located at an upper side of the first position in the range of 200 mm to 300 mm. Incidentally, each of the first and second opening portions 305*a* and 305*b* has a substantially elliptical shape. Each of the first and second opening portions 305*a* and 305*b* has a major axis of substantially from 40 to 60 mm, and a minor axis of substantially from 20 to 40 mm.

The reinforced electric pole 3 is also provided with the reinforcing portion 307 provided in the inner hollow portion 303 of the electric pole 3 on the base portion 306 thereof.

Figure 9:
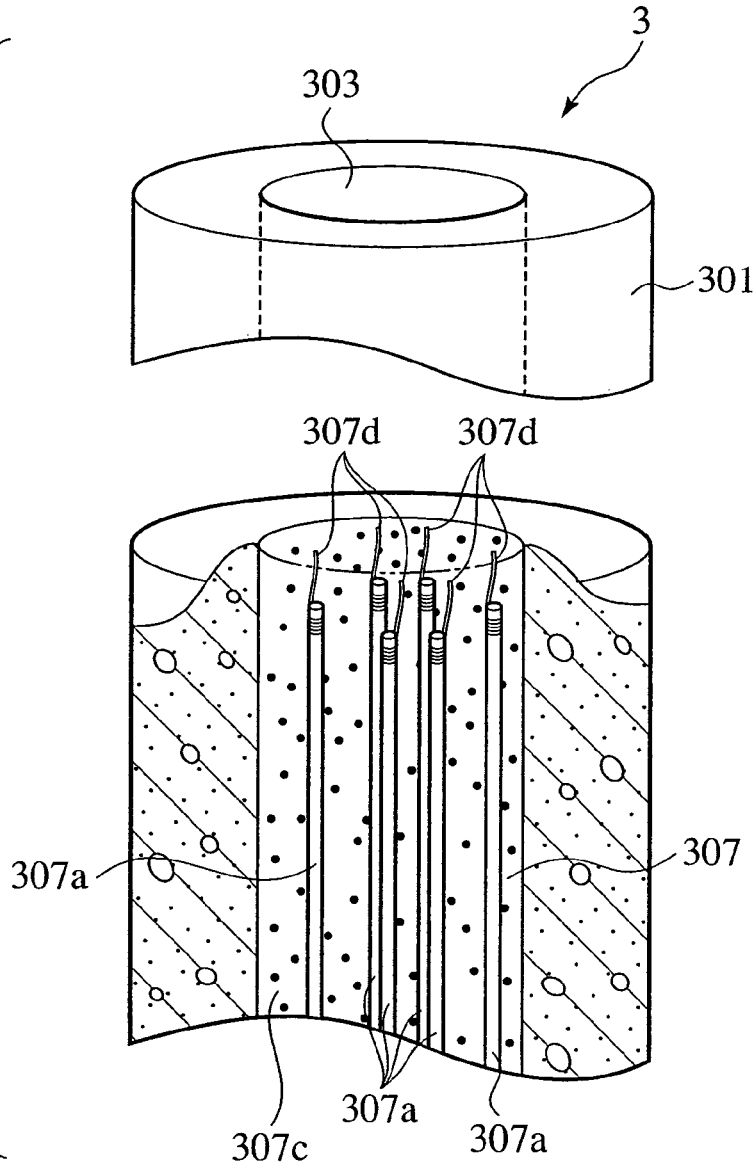
FIG. 9 is an enlarged perspective cross sectional view showing a detailed structure of the reinforcing portion of the electric pole shown in FIG. 8.

FIG. 9 is an enlarged perspective cross sectional view showing a detailed structure of the reinforcing portion 307.

As shown in FIGS. 8 and 9, the reinforcing portion 307 comprises a plurality of aramid rods 307*a* mounted on the base portion 306, and filling material 307*b* filled in a gap between the aramid rods 307*a* and the inner hollow portion 303 so that the aramid rods 307*a* are arranged substantially in the longitudinal direction (axial direction) of the electric pole 3.

String members 307*d* are fixedly connected to one end portions (upper end portions) of the aramid rods 307*a*, respectively.

That is, one end portion of the string member 307*d* is wound around an outer periphery of the one end portion of the aramid rod 307*a* to be fixedly connected thereto, or the one end portion of the string member 307*d* is fixed with a screw or the like to the outer periphery of the one end portion of the aramid rod 307*d*.

In FIG. 9, only six aramid rods 307*a* are shown, but, the present invention is not limited to the structure.

That is, the number of aramid rods 307*a* inserted in the inner hollow portion 303 are determined depending on a diameter of the inner hollow portion 303, the degree required for reinforcement and the like.

Each of the aramid rods 307*a* has a longitudinal (axial) length of substantially 1800 mm to 2000 mm, and the longitudinal length of each aramid rod 307*a* is accordingly adjusted depending on the requirements of a portion of the electric pole 3 to be reinforced, similarly to the second embodiment.

Unshrinkable mortar which, while the unshrinkable mortar is filled in the gap between the aramid rods 307*a* and the inner hollow portion 303, allows its strength to be increased and is not shrinkable even if it is solidified may be used as the filling material 307*c*. Moreover, resin such as epoxy, concrete or other similar material may be used as the filling material 307*c*.

The amount of injecting pieces of mortar, pieces of sand or pieces of gravel is adjusted in a similar manner to the first and second embodiments.

Figure 10:
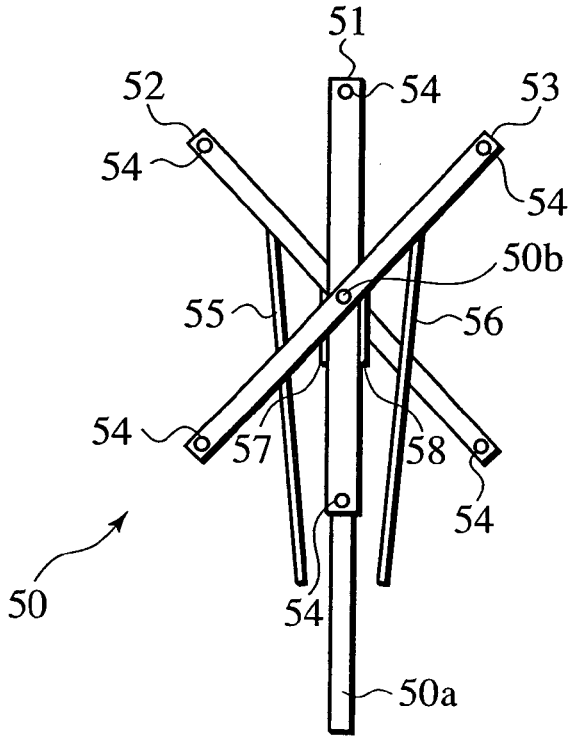
FIG. 10 is a structural view showing a reinforcing member arrangement jig used for the reinforcing method according to the third embodiment.

FIG. 10 is a view showing a reinforcing member arrangement jig used for the reinforcing method according to the third embodiment.

As shown in FIG. 10, a jig 50 is provided with a base bar 50*a*, and a first, second and third rod-like supporting members 51, 52 and 53 each composed of, for example, aluminum and having the same length in its longitudinal direction.

The length of each of the supporting members 51, 52 and 53 is substantially equal to a diameter (bore diameter) of the inner hollow portion 303 of the electric pole 3.

The first supporting member 51 is fixed on one end portion of the base bar 50*a*, and the second and third supporting members 52 and 53 are rotatably supported at their middle portions to the first supporting member 51 by a pin member 50*b*.

The jig 50 is also provided with a pair of first and second handling arms 55 and 56 which are attached to first and second portions of the second and third supporting members 52 and 53, respectively The distance between the first position and the pin member 50*b* and that between the second position and the pin member 50*b* are substantially equal to each other.

Both end portions of each of the first, second and third supporting members 51, 52 and 53 are formed with through holes 54 allowing the string members 307*d* to be put therethrough.

Lengths of the formed positions of the through holes 54 from the pin member 50*b* are substantially the same.

In the third embodiment, because of assuming to insert six aramid rods 307*a* into the inner hollow portion 303 of the electric pole 3, six through holes 54 are formed in the total of the jig 50.

The jig 50 is also provided at the first supporting member 51 with a pair of stoppers 57 and 58 for releasable locking the second and third supporting members 52 and 53.

When the second and third supporting members 52 and 53 are rotated (opened) away from the base bar 50*a* by the first and second handling arms 55 and 56 being handled to be moved toward other end portion of the base bar 50*a*, the stoppers 57 and 58 allow the second and third supporting members 52 and 53 to be locked so that the first, second and third supporting members 51, 52 and 53 are positioned at an angle of 60° (degrees) among them, making it possible to arrange the first, second and third supporting members 51, 52 and 53 at the same intervals among them in a circumferential direction (rotational direction) with respect to the pin member 50*b*.

That is, when the second and third supporting members 52 and 53 are locked by the stoppers 57 and 58, each of the through holes 54 is arranged on a circle at the center of the pin member 50*b* at the same intervals among them in the circumferential direction.

Figure 11:
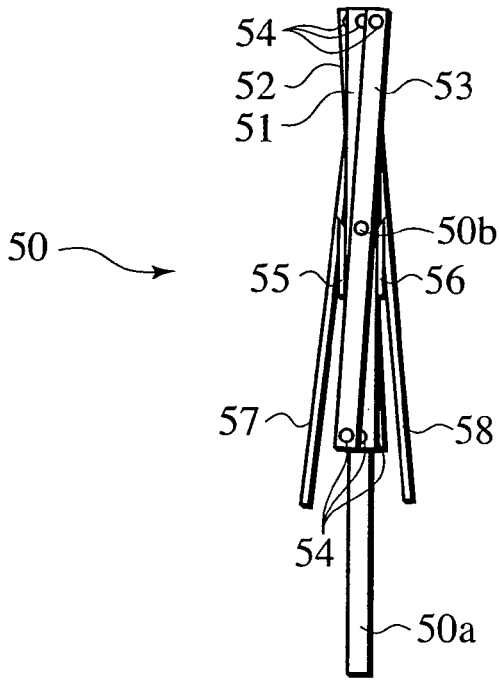
FIG. 11 is a structural view showing a state of the jig shown in FIG. 10 in which second and third supporting members are closed.

FIG. 11 shows a state of the jig 50 in which the handling arms 55 and 56 are handled to be moved toward the one end portion of the base bar 50*a* so that the second and third supporting members 52 and 53 are rotated toward the base bar 50*a* to be closed. The closed state of the jig 50 shown in FIG. 11 allows itself to be inserted through the second opening portion 305*b*.

Figure 12A:
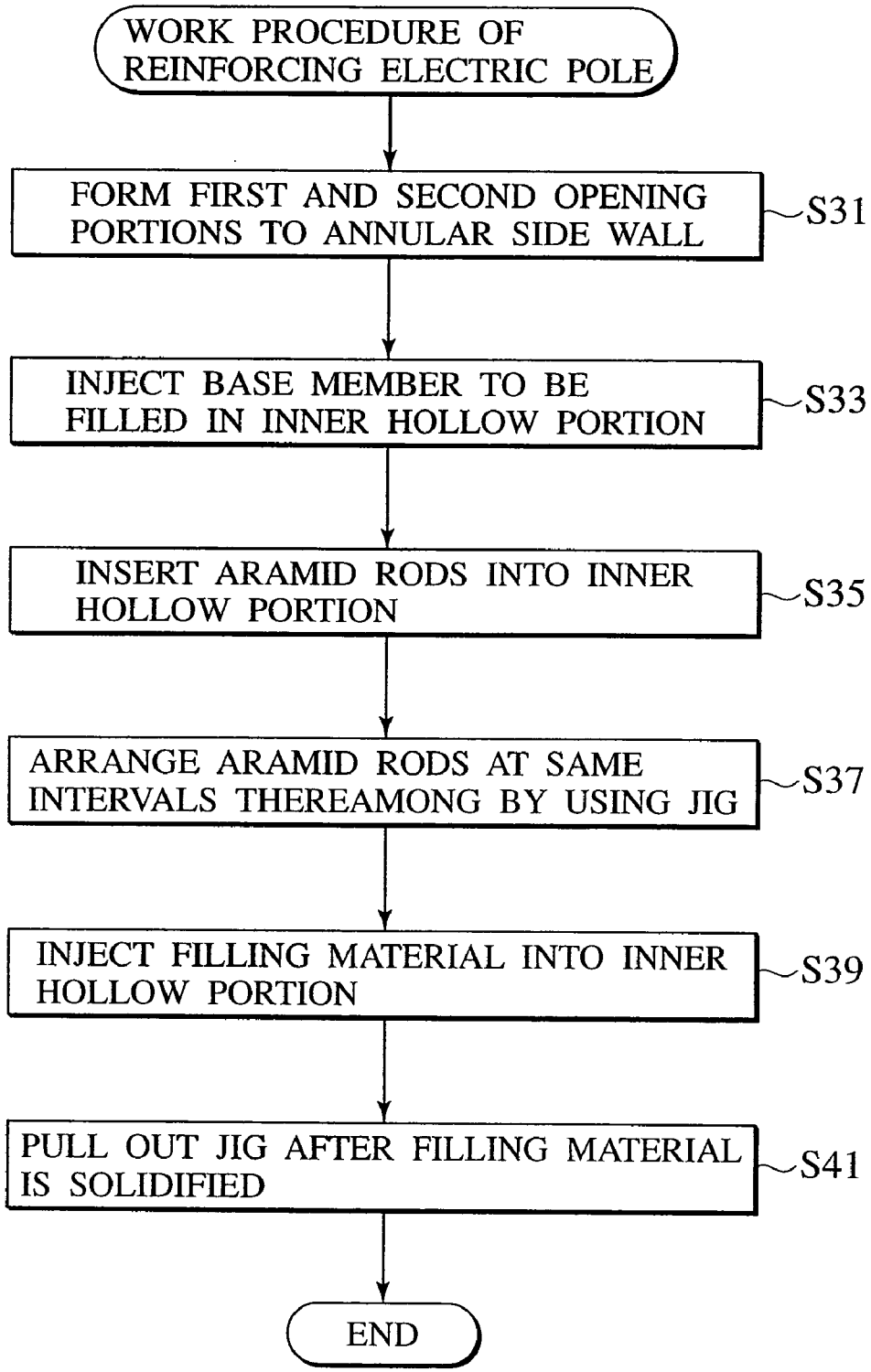
FIG. 12A is a flowchart showing a working procedure of reinforcing the electric pole which has not been reinforced yet according to the third embodiment.
Figure 12B:
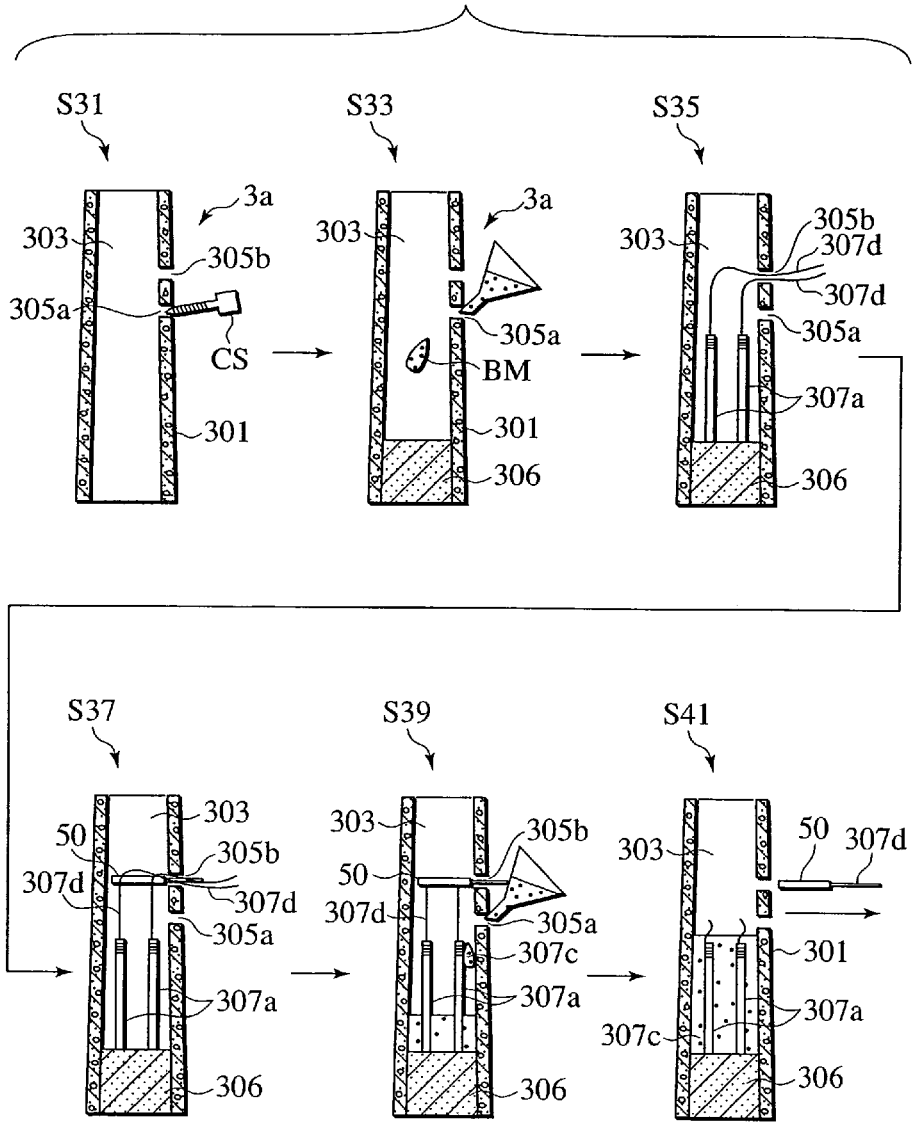
FIG. 12B is a view pictorially showing the working procedure shown in FIG. 12A.

FIG. 12A is a flowchart showing a working procedure of reinforcing the electric pole 3*a* which has not been reinforced yet according to the third embodiment. FIG. 12B pictorially shows the working procedure shown in FIG. 12A.

At first, suitable portions of the annular side wall 301 are drilled with the core sampling drill CS so that the first and second opening portions 305*a* and 305*b* are formed to the suitable portions of the annular side wall 301 (step S31).

Next, base members BM such as pieces of mortar, pieces of sand or pieces of gravel are injected from the first opening portion 305*a* to be filled in the inner hollow portion 303 of the lower portion of the pole 3*a* under the ground, forming the base portion 306 therein (step S33).

After the work in step S33, the six aramid rods 307*a* connected to the string members 307*d* are inserted through the second opening portion 305*b* into the inner hollow portion 303 to be mounted on the base portion 306 (step S35). In step S35, each other end portion of each of the string members 307*d* is pulled away through the second opening 305*b* from the inner hollow portion 303 to be exposed to the outside thereof.

Figure 13:
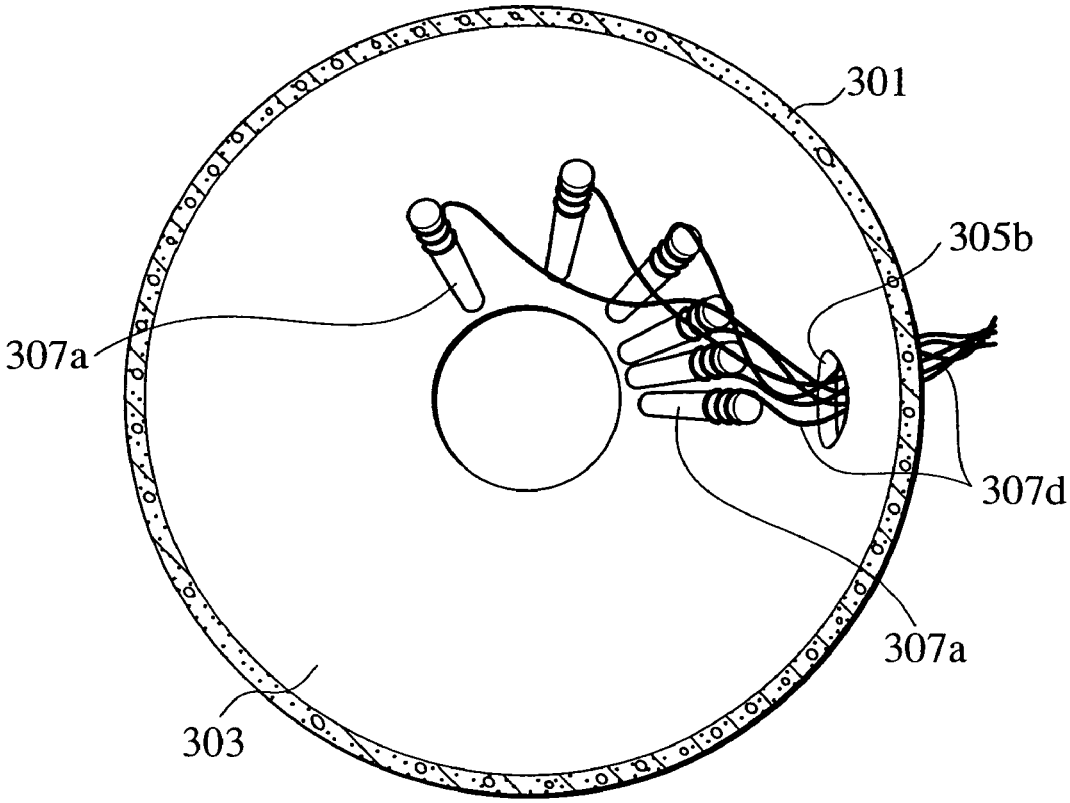
FIG. 13 is a lateral cross sectional view at an upper side of a second opening portion of the electric pole shown in FIG. 8 from a view of an upper side thereof, showing a state that aramid rods are inserted in an inner hollow portion of the electric pole shown in FIG. 8 according to the third embodiment.

FIG. 13 is a lateral cross sectional view at an upper side of the second opening portion 305*b* from the view of the upper side thereof, showing a state that the aramid rods 307*a* are inserted in the inner hollow portion 303 of the electric pole 3*a*.

Figure 14:
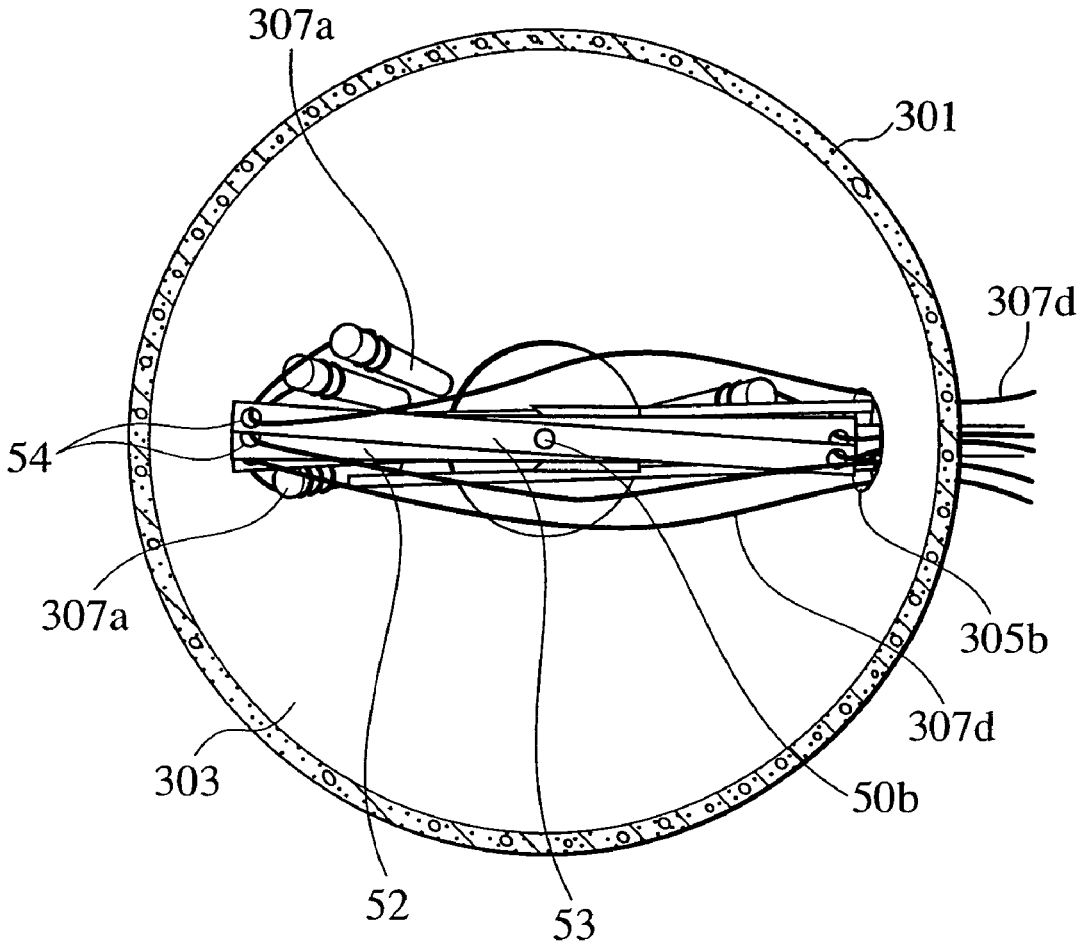
FIG. 14 is a lateral cross sectional view at an upper side of a second opening portion of the electric pole shown in FIG. 8 from a view of an upper side thereof, showing a state that the jig is inserted in the inner hollow portion of the electric pole shown in FIG. 8 according to the third embodiment.

Next, in step S37, the string members 307*d* are put from their other end portions through the through holes 54 of the jig 50, respectively, and the jig 50 is inserted from its one end portion through the second opening portion 305*b* into the inner hollow portion 303 of the electric pole 3*a*, shown in FIG. 14.

Further, in step S37, the handling arms 55 and 56 are handled to be pulled in a direction away from the electric pole 3*a* so that the second and third supporting members 52 and 53 are rotated (opened) away from the base bar 50*a*, whereby the first, second and third supporting members 51, 52 and 53 are locked to be positioned at an angle of 60° among them by the stoppers 57 and 58, respectively.

That is, the first, second and third supporting members 51, 52 and 53 are positioned on a circular locus determined by the rotations of the second and third supporting members 52 and 53 at the same intervals among them in the circumferential direction with respect to the pin member 50*b*.

Figure 15:
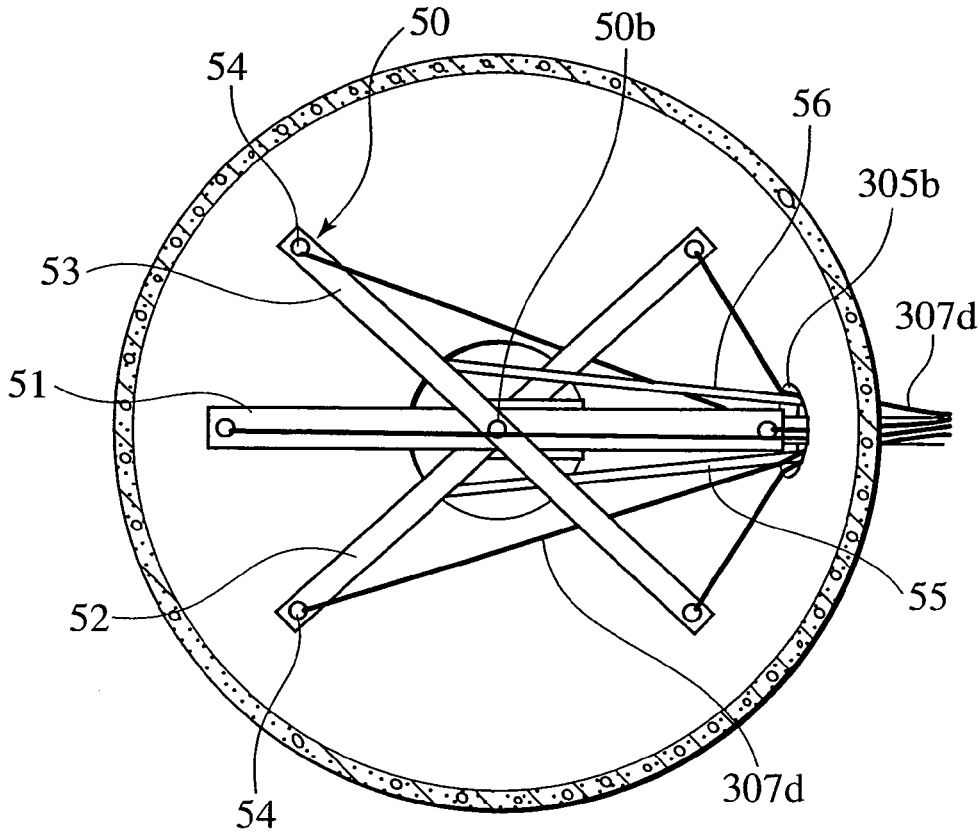
FIG. 15 is a lateral cross sectional view at an upper side of a second opening portion of the electric pole shown in FIG. 8 from a view of an upper side thereof, showing a state that the aramid rods are suspended by the jig according to the third embodiment.

After the handling work, in step S37, the string members 307*d* exposed out of the electric pole 3 are pulled in the direction away from the electric pole 3*a* so that the string members 307*d* get to be tensioned, causing the aramid rods 307*a* to be suspended by the jig 50, as shown in FIG. 15. In the state of the jig 50 shown in FIG. 15, the handling arms 55 and 56, and the base bar 50*a* are integratedly fixed by wrapping them with a wrapping member such as a packing tape.

Because, in step S37, the first, second and third supporting members 51, 52 and 53, that is all through holes 54 are positioned on the circular locus at the same intervals thereamong, the aramid rods 307*a* connected to the tensioned string members 307*d* and supported by the first, second and third supporting members 51, 52 and 53 are positioned on the circular locus at the same intervals in the circumferential direction, respectively, in the inner hollow portion 303.

Figure 16:
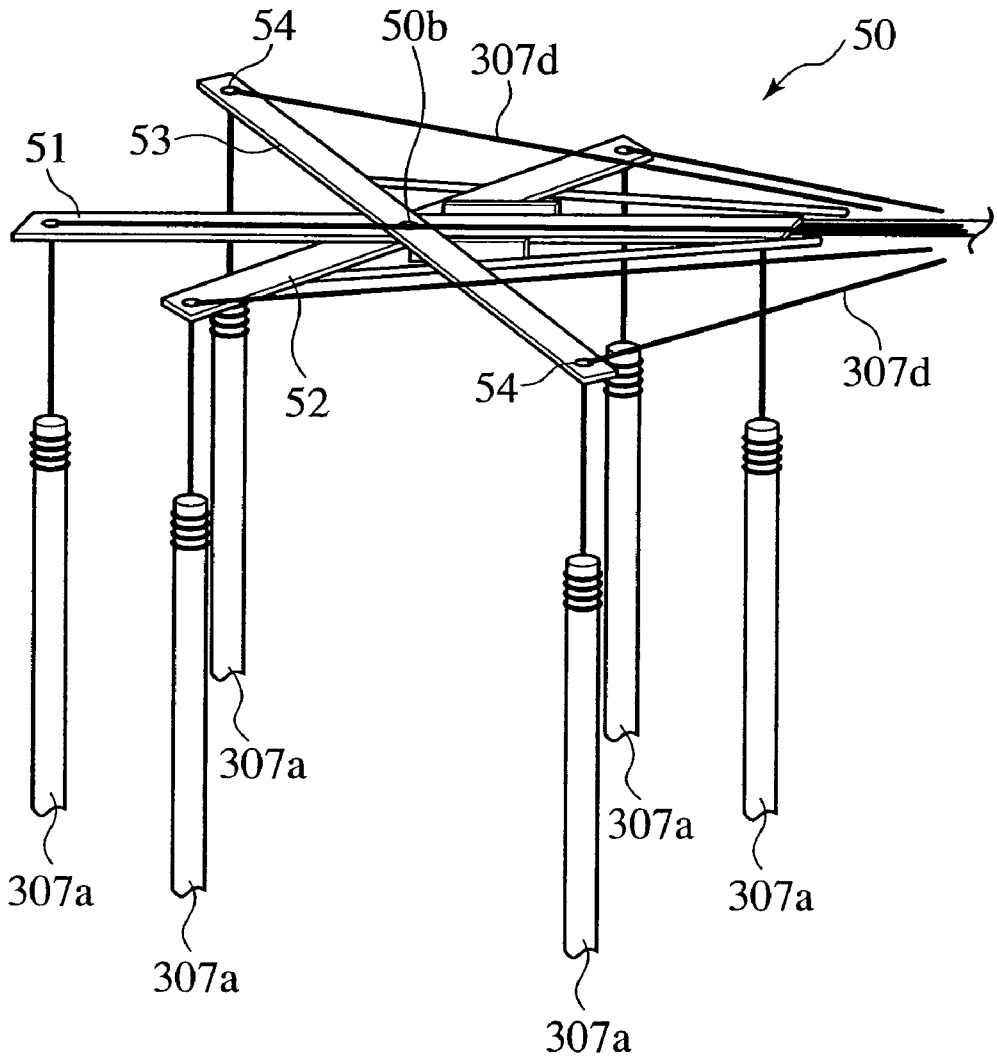
FIG. 16 is a perspective view showing an arrangement of the aramid rods in the inner hollow portion shown in FIG. 8 according to the third embodiment.

FIG. 16 is a perspective view showing a state that all of the aramid rods 307*a* are positioned on the circular locus at the same intervals in the circumferential direction in substantially parallel to the axial direction, respectively in the inner hollow portion 303.

Incidentally, the jig 50 shown in FIGS. 10, 11, 14, 15 and 16 is an example of the jig. That is, the structure of jig is naturally changed depending on the number of aramid rods 307*a* inserted in the inner hollow portion 303 of the electric pole 3.

In cases of using any jig, when the supporting members are rotated to be opened, any jig has an invariant configuration such that all of the through holes are positioned on the circle determined with respect to the pin member 50*b*.

After this work in steps S35 and S37 such that all aramid rods 307*a* are positioned at the same intervals thereamong in the circumferential direction, the filling material 307*c* is injected from the first opening portion 305*a* into the inner hollow portion 303 up to the height adjacent to the top portions of the aramid rods 307*a*, while the all aramid rods 307*a* are supported by the jig 50 (step S39).

After the injected filling material 307*c* is solidified, the wrapping member is demounted from the jig 50 to be released from its fixed state. Next, the handling arms 55 and 56 are moved toward the one end portion of the base bar 50*a* so that the second and third supporting members 52 and 53 are rotated toward the base bar 50*a* to be closed, as shown in FIGS. 11 and 14. The jig 50 whose supporting members 52 and 53 become the closed state is pulled out from the inner hollow portion 303 through the second opening portion 305*b*, removing the string members 307 from the through holes 54 of the jig 50, respectively (step S41).

Incidentally, in step S41, it is possible to pull out the jig 50 immediately after the filling material 307*c* is filled. Moreover, parts of the string members 307*d* which are exposed out of the electric pole 3*a* are cut.

After the work in step S41, the first and second opening portions 305*a* and 305*b* are sealed. When the earth holes are used as the first and second opening portions, earth hole covers are fitted in the earth holes. When the first and second opening portions are formed with the core sampling drill, an aramid fiber seat may be wound around a portion of the outer periphery of the annular side wall including the formed first and second opening portions.

The reinforcing work is carried out in accordance with the described procedure shown in FIG. 12A so that the reinforced electric pole 3 shown in FIGS. 8 and 9 is accomplished.

Incidentally, after carrying out the work in step S41, in cases where it can be accepted to reinforce the reinforced electric pole 3 from the outer periphery thereof after sufficient consideration of constrains due to the installation requirements of the electric pole 3 and the reinforcing cost thereof, it may be possible to wind a seat member such as an aramid fiber seat or the like around an outer periphery of the annular side wall 301.

The third embodiment of the present invention properly can obtain the same effects of the first and second embodiments.

In addition, according to the third embodiment, the jig used for arranging the aramid rods in the inner hollow portion 303 of the electric pole 3, allows the aramid rods to be easily fixed. Furthermore, it is possible to pull out the jig after the injected filling member being solidified to repeatedly use the jig, thereby remarkably shortening the working time of reinforcing the electric pole and saving the cost of the working time.

Incidentally, the jig 50 is configured so that the handling arms 55 and 56 allow the second and third supporting members 52 and 53 to be rotated, but the present invention is not limited to the configuration.

Figure 17:
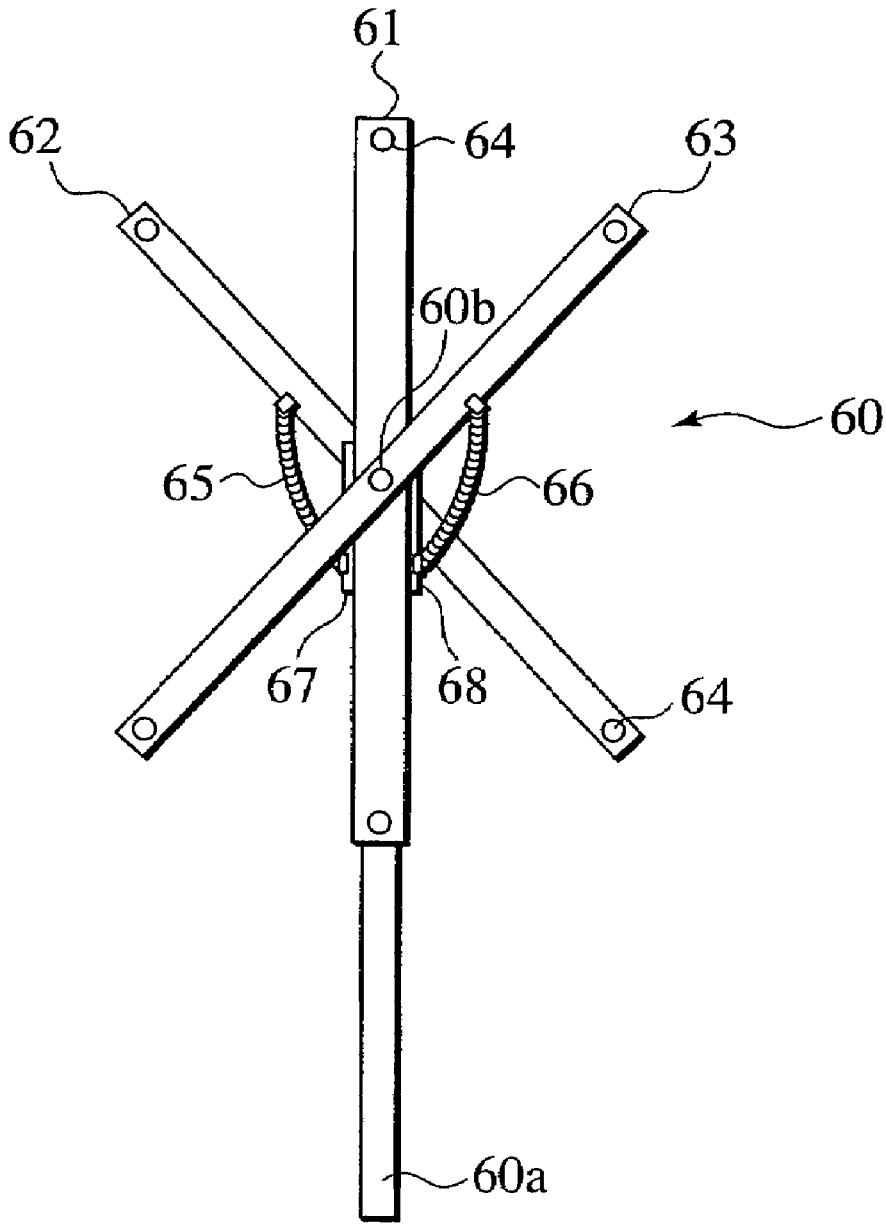
FIG. 17 is a structural view showing a modification of the jig according to the third embodiment.

For example, FIG. 17 shows a modification of the jig 60 according to the third embodiment.

That is, similarly to the third embodiment, the jig 60 comprises a base bar 60*a* corresponding to the base bar 50*a*, a first, a second and a third supporting members 61, 62 and 63 corresponding to the first, second and third supporting members 51, 52 and 53. The both end portions of each of the first, second and third supporting members 61, 62 and 63 are formed with through holes 64 corresponding to the through holes 54.

In particular, in the modification, the jig 60 is provided with a first and a second elastic members 65 and 66. The first elastic member 65 is connected between the first supporting member 61 and the second supporting member 62, and the second elastic member 66 is connected between the first supporting member 61 and the third supporting member 66.

That is, while the second and third supporting members 62 and 63 are opened so that the first, second and third supporting members 61, 62 and 63 are positioned at the same intervals among them in the circumferential direction with respect to a pin member 60*b* corresponding to the pin member 50*b*, the second supporting member 62 is biased by the first elastic member 65 away from the first supporting member 61 but the second supporting member 62 is locked by the stopper 67. Similarly, the third supporting member 63 is biased by the second elastic member 66 away from the first support member 61 but the third supporting member 63 is locked by the stopper 68.

In cases of using the jig 60 shown in FIG. 17, at first, the jig 60 is inserted into the inner hollow portion 303 while the second and third supporting member 62 and 63 are subjected to external forces to be moved against the biasing forces toward the first supporting member 61, respectively.

After inserting the jig 60 in the inner hollow portion 303, no external forces are applied to the second and third supporting member 62 and 63 so that they are automatically moved toward the first supporting member 61 by the elastic forces of the elastic members 65 and 66, causing the second and third supporting member 62 and 63 to be locked by the stoppers 67 and 68, respectively.

As a result, the first, second and third supporting members 61, 62 and 63 are automatically positioned at an angle of 60° among them in the circumferential direction with respect to the pin member 60*b* in the inner hollow portion 303.

Therefore, the jig 60 can not be pulled out from the inner hollow portion of the electric pole toward the outside thereof, so that a new jig 60 is used with executing each reinforcement. However, except for this point, using the jig 60 allows similar effects of the third embodiment to be obtained.

Fourth Embodiment

A fourth embodiment of the present invention will be described hereinafter with reference to FIGS. 18 to 29.

A method of reinforcing an electric pole according to the fourth embodiment, similarly to the third embodiment, has a step of forming at least two opening portions (a first opening portion and a second opening portion) in an annular side wall of the electric pole, a step of injecting material for base such as pieces of mortar, pieces of sand or pieces of gravel from the first opening portion for forming a base for reinforcement into an inside of the annular side wall and a step of inserting a plurality of reinforcing members from the second opening portion into the inside of the annular side wall.

As the reinforcing member, a plurality of aramid rods are used, but, in the fourth embodiment, each of the reinforcing members is provided with an aramid rod and a special reinforcement. The special reinforcement has an outer peripheral surface which is not flat and is fixedly connected to one end portion (lower end portion) of the aramid rod with a fixing member. The connection of the special reinforcement to the aramid rod causes the reinforcing member to be increased in weight, preventing, after the injection of the filling material in the inner hollow portion, the reinforcing member from being floated due to buoyant force of the filling material. The prevention of floating the reinforcing member allows a reinforced portion in the inner hollow portion to be stable, making it possible to increase the reinforcing strength.

A string member is connected at its one end portion to each other end portion (upper end portion) of each of the aramid rods. Each string member connected to each aramid rod is also connected to a jig for arranging each reinforcing member in the inside of the annular side wall of the electric pole.

Handling the jig allows the plurality of reinforcing members to be arranged in the inside of the inner hollow portion at regular intervals thereamong.

As the string member connected to the aramid rod, a linear string, a stainless wire or the like is used, and the string member has a substantially 1 to 3 mm in diameter, and preferably, has a substantially 1.5 mm in diameter.

Each of the reinforcing members (each of the aramid rods and each of the special reinforcements) has a substantially 15 to 25 mm in diameter, and preferably, has a substantially 15 to 20 mm in diameter.

The string member can be fixed to the reinforcing member in the same manners according to the third embodiment.

The increase of the weight of the reinforcing member needs a more hard jig for arranging each reinforcing member in the inside of the annular side wall of the electric pole. Then, in the fourth embodiment, two jigs for arranging each reinforcing member in the inside of the annular side wall of the electric pole are used.

Figure 18:
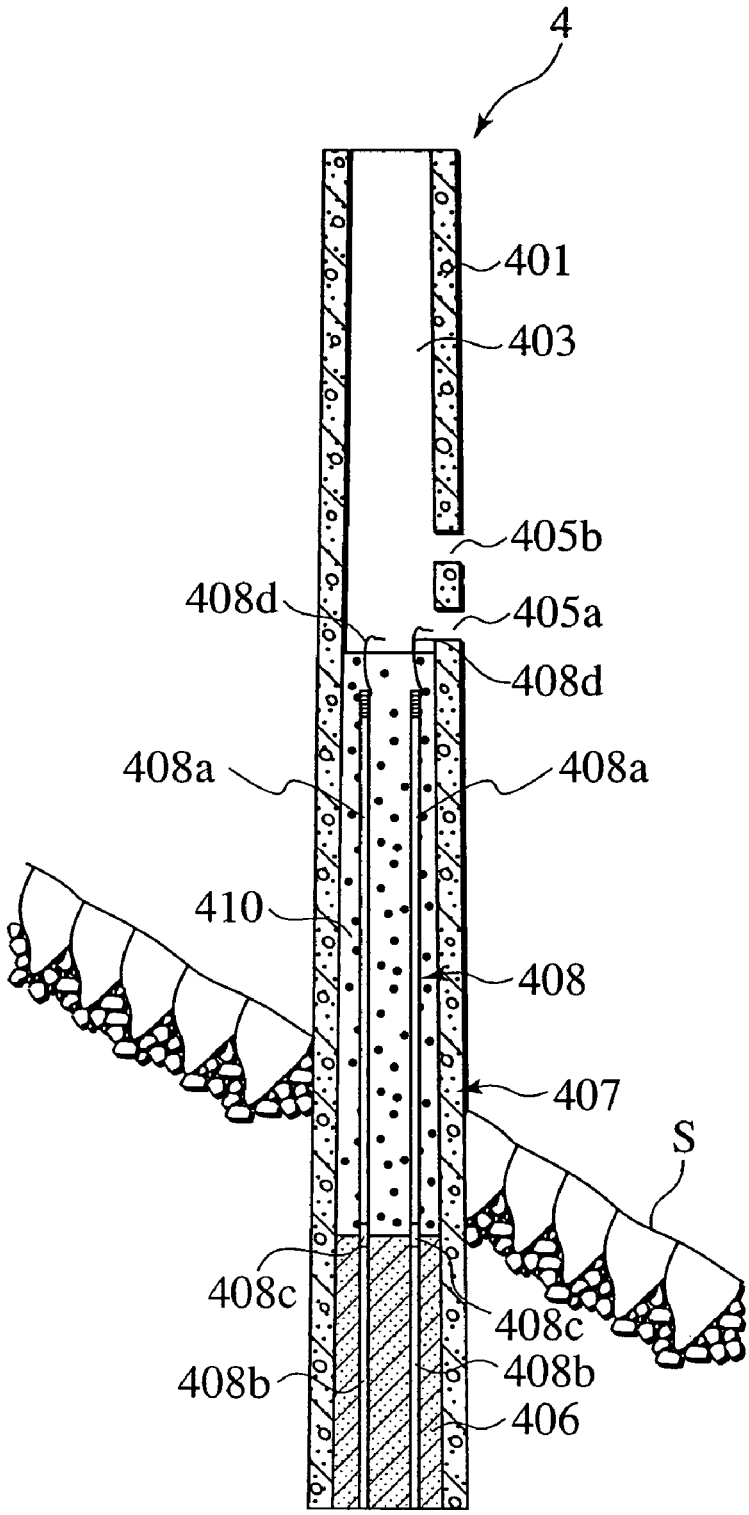
FIG. 18 is a partially longitudinal cross sectional view showing a structure of an electric pole which is already reinforced by a reinforcing method according to a fourth embodiment of the present invention.

FIG. 18 is a partially longitudinal cross sectional view showing a structure of an electric pole 4 which is already reinforced by the reinforcing method according to the fourth embodiment.

As shown in FIG. 18, the reinforced electric pole 4 is installed under the ground so as to stand the surface S thereof and has a substantially tubular shape to be gradually tapered toward its top portion, similar to the first, second and third embodiments.

The reinforced electric pole 4 is provided with an annular side wall 401 composed of reinforced concrete and an inner hollow portion 403 provided inside of the annular side wall 401.

The reinforced electric pole 4 is formed with a first opening portion 405*a* and a second opening portion 405*b* penetrated through predetermined first and second positions of the annular side wall 401 of the electric pole 4 above the surface S of the ground.

In FIG. 18, the first position and the second position are axially arranged, but the present invention is not limited to the structure so that the first and second opening portions may be located to desired portions of the annular side wall above the surface S of the ground.

An earth hole, or a hole portion formed to a predetermined position of the annular side wall 401 to which at least one of the scaffold volts is removed may be used as at least one of the first and second opening portions 405*a* and 405*b*, and in cases where no hole portions are formed to suitable portions of the annular side wall 401, the first and second opening portions may be formed with a core sampling drill or the like.

The first position to which the first opening portion 405*a* is formed and the second position to which the second opening portion 405*b* is formed are located similarly to the third embodiment.

The reinforced electric pole 4 is provided with a base portion 406 which is located under the ground and is formed with base members, such as a predetermined amount of mortar, a predetermined amount of pieces of sand or a predetermined amount of pieces of gravel injected from the first opening portion 405*a* to be filled in the inner hollow portion 403 of the lower portion of the pole 4 under the ground, similarly to the third embodiment.

The reinforced electric pole 4 is also provided with the reinforcing portion 407 provided in the inner hollow portion 403 of the electric pole 4.

The reinforcing portion 407 comprises a plurality of reinforcing members 408 each having an aramid rod 408*a*. Each of the aramid rods 408*a* has a substantially 15 to 25 mm in diameter, and preferably, has a substantially 17 to 19 mm in diameter.

The reinforcing member 408 also comprises a plurality of special reinforcements (reinforcing bars) 408*b* each having the same diameter of each of the aramid rods 408*a* and mounted in the base portion 406. The reinforcing member 408 further comprises a plurality of fixing members 408*c* for coaxially connecting the upper end portions of the special reinforcements 408*b* to the aramid rods 408*a*, respectively.

Each string member 408*d* has one and other end portions, and each one end portion of which is fixedly connected to each upper end portion of each aramid rod 408*a*.

The fixedly connecting manner of the string member 408*d* and the aramid rod 408*a* is similar to the third embodiment.

The reinforcing portion 407 further comprises a filling material 410 filled in a gap between the aramid rods 408*a* and the inner hollow portion 403 so that the aramid rods 408*a* are arranged substantially in the longitudinal direction (axial direction) of the electric pole 4.

The longitudinal length of the special reinforcement 408*b* is adjusted so that, when the special reinforcement 408*b* is fixedly connected through the fixing member 408*c* to the lower end portion of the aramid rod 408*a*, the total longitudinal length of the aramid rod 408*a* and the special reinforcement 408*b* substantially equals to the range from the first opening portion 405*a* to the boundary portion of the electric pole 4. Therefore, the special reinforcement 407*b* has a substantially 700 mm to 900 mm in longitudinal length, preferably, a substantially 800 mm.

The special reinforcement 408*b* allows the weight of the reinforcing member 408 itself to be stable, and prevents the reinforcing member from being floated after the injection of the filling material 410.

Moreover, because the total longitudinal length of the aramid rod 408*a* and special reinforcement 408*b* is reached up to substantially 2500 mm to 2900 mm, it is hard to transport the combination members each consisting of the aramid rod 408*a*, the special reinforcement 408*b* and the fixing member 408*c*.

Then, in the fourth embodiment, the aramid rods 408*a*, the special reinforcements 408*b* and the fixing members 408*c* are separately transported, and when the aramid rods 408*a*, the special reinforcements 408*b* and the fixing members 408*c* are reached at a location where the electric pole 4 is installed, the aramid rods 408*a* and the special reinforcements 408*b* are fixedly connected via the fixing members 408*c*, respectively, assembling the reinforcing members 408. Therefore, it is possible to easily carry out the transport of the reinforcing members.

Figure 19:
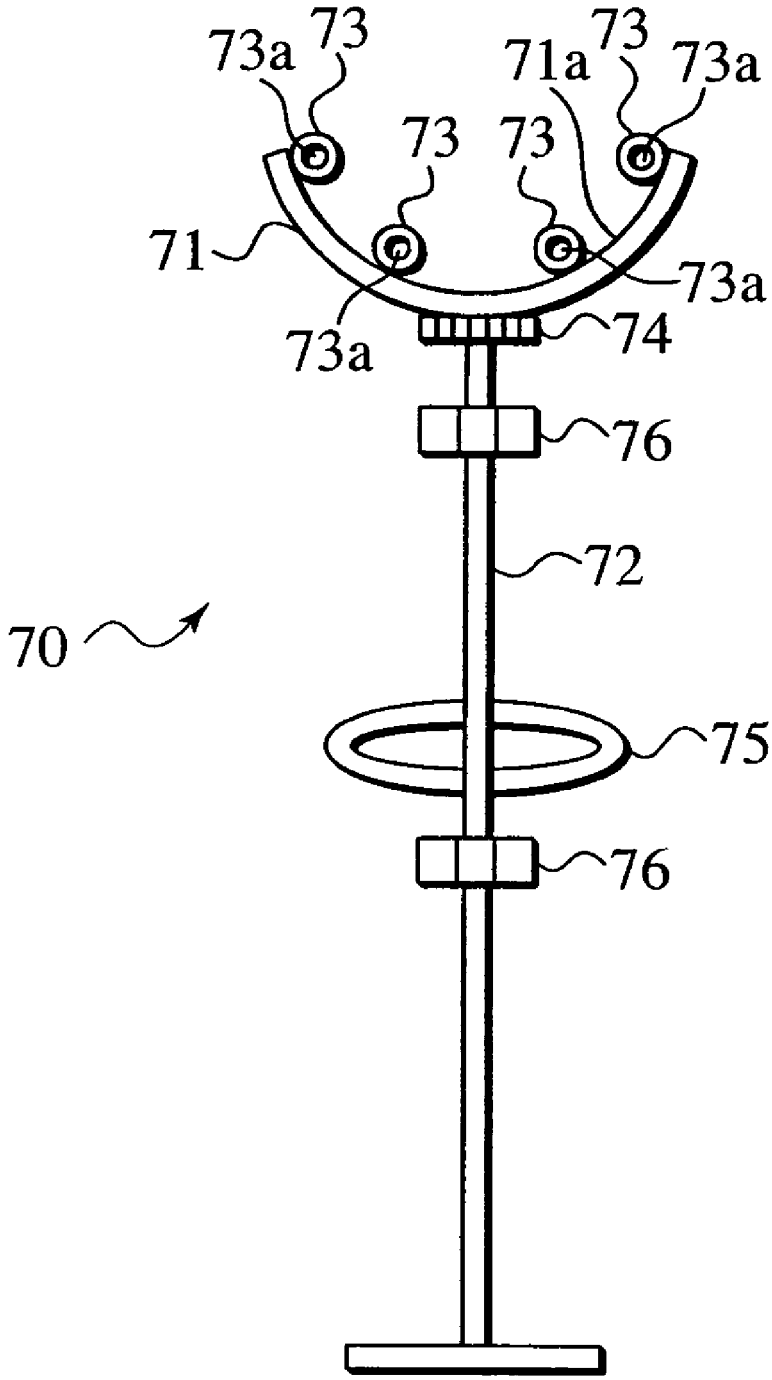
FIG. 19 is a structural view showing a first jig for arranging reinforcing members used for the reinforcing method according to the fourth embodiment.
Figure 20:
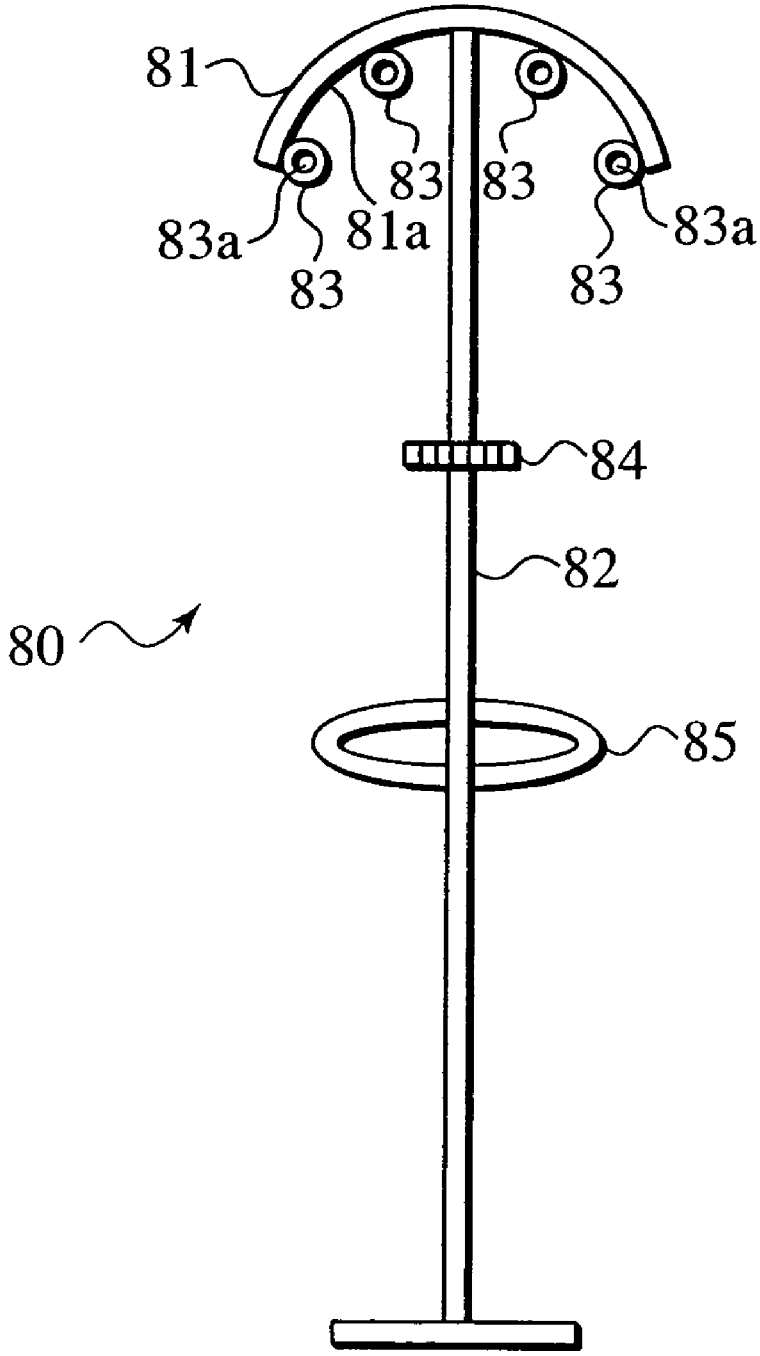
FIG. 20 is a structural view showing a second jig for arranging reinforcing members used for the reinforcing method according to the fourth embodiment.

FIG. 19 is a structural view showing a first jig 70 for arranging reinforcing members used for the reinforcing method according to the fourth embodiment, and FIG. 20 is a structural view showing a second jig 80 for arranging reinforcing members used for the reinforcing method according to the fourth embodiment.

The first jig 70 shown in FIG. 19 is composed of a special reinforcing bar whose outer periphery is uneven.

The first jig 70 comprises a first supporting member 71 having a substantially arc shape for supporting the reinforcing members 408, and a base bar 72 having one end portion to which the first supporting member 71 is fixed so that an inner arc surface 71*a* of the first supporting member 71 faces toward the direction away from the base bar 72 in the longitudinal direction.

The first jig 70 is also provided with a plurality of suspending portions 73 fixedly mounted on the inner arc surface 71*a* by, for example, welding.

Each of the suspending portions 73 has a through hole 73*a* an axial direction of which is orthogonal to the longitudinal direction of the base bar 72 and to the radial direction of the first supporting member 71.

Each of the suspending portions 73 is configured to allow the string member 408*d* to be put therethrough.

That is, because the positions of the through holes 73*a* are fixed, in cases where the first jig 70 is arranged with the radial direction of the first supporting member 71 being horizontally positioned and other end portions of the string members 408*d* are put through the through holes 73*a*, when the other end portions of the string members 408*d* are pulled, all of the string members 408*d* are tensioned so that the reinforcing members 408 are supported by the through holes 73*a* of the suspending portions 73 of the first supporting member 71 in the axial direction of each through hole 73*a*.

The suspending portions 73 can be mounted on the inner arc surface 71*a* at the same intervals in the circumferential direction.

In FIG. 19, only four suspending portions 73 are shown, but, the present invention is not limited to the structure.

That is, the number of suspending portions 73 are determined depending on the number of the reinforcing members 408 and a diameter of the inner hollow portion 403, the degree required for reinforcement and the like. Furthermore, in FIG. 19, each of the through holes 73*a* has a substantially circular shape, but this structure is one example of the jig. That is, each of the through holes 73*a* may have another shape such as a substantially elliptical shape, or a substantially rectangular shape.

In addition, the first jig 70 comprises an eyehole portion 74 having a plurality of eyeholes 74*a* each axial direction of which is parallel to the longitudinal direction of the base bar 72. When the string members 408*d* are exposed from the through holes 73*a* of the suspending portions 73, the eyeholes 74*a* allow the exposed string members 408*d* to be easily pulled out. The first jig 70 also comprises a handed portion 75 having a substantially circular shape and formed on a middle portion of the base bar 72 so as to project orthogonally to the longitudinal direction of the base bar 72. The handled portion 75 is configured to allow the first jig 70 to be handled so that it is easy to insert the first jig 70 into the inner hollow portion 403.

Furthermore, the first jig 70 comprises jig supporting portions 76 formed on the base bar 72 so that the second jig 80 can be mounted to be supported when supporting the reinforcing members.

The number of jig supporting portions 76 is not limited to the two.

That is, desired number of jig supporting portions 76 may be formed on the base bar 72 depending on the weight of the second jig 80.

The second jig 80 shown in FIG. 20 is composed of a special reinforcing bar similarly to the first jig 70.

The second jig 80 comprises a second supporting member 81 having a substantially arc shape for supporting the reinforcing members 408, and a base bar 82 having one end portion to which the second supporting member 81 is fixed so that an inner arc surface 81*a* of the second supporting member 81 faces toward the base bar 72 itself in the longitudinal direction.

The second jig 80 is also provided with a plurality of suspending portions 83 fixedly mounted on the inner arc surface 81*a* by, for example, welding.

Each of the suspending portions 83 has a through hole 83*a* an axial direction of which is orthogonal to the longitudinal direction of the base bar 82 and to the radial direction of the second supporting member 81.

Each of the suspending portions 83 is configured to allow the string member 408*d* to be put therethrough.

That is, because the positions of the through holes 83*a* are fixed, in cases where the second jig 80 is arranged with the radial direction of the second supporting member 81 being horizontally positioned and other end portions of the string members 408*d* are put through the through holes 83*a*, when the other end portions of the string members 408*d* are pulled, all of the string members 408*d* are tensioned so that the reinforcing members 408 are supported by the through holes 83*a* of the suspending portions 83 of the second supporting member 81 in the axial direction of each through hole 83*a*.

The suspending portions 83 can be mounted on the inner arc surface 81*a* at the same intervals in the circumferential direction.

In FIG. 20, only four suspending portions 83 are shown, but, the present invention is not limited to the structure, similarly to the first jig 70. Furthermore, in FIG. 20, each of the through holes 83*a* has a substantially circular shape, but this structure is one example of the jig, similarly to the first jig 70.

In addition, the second jig 80 comprises an eyehole portion 84 having a plurality of eyeholes 84*a* which have substantially similar functions of the eyehole portion 74 and the eyeholes 74*a*. Furthermore, the second jig 80 also comprises a handed portion 85 which is similarly served as the handled portion 85, and jig supporting portions 86 formed on the base bar 82 so that the first jig 70 can be mounted to be supported when supporting the reinforcing members, similarly to the first jig 70.

Each of the total axial lengths of each of the first and second jigs 70 and 80 has a substantially 1000 mm to 1200 mm so that each size of each of the first and second supporting members 71 and 81 is determined according to the diameter of the inner hollow portion 403 of the electric pole to be reinforced. An example of each arc length of each of the first and second supporting members 71 and 81 is substantially 230 mm.

The first and second supporting members 71 and 81 are substantially symmetrical with each other. That is, when the first and second supporting members 71 and 81 are parallely arranged at different heights so that the whole shape of the combination of the first and the second supporting members 71 and 81 parallely arranged at different heights in view of an upper side of the combination appears to be substantially circular shape.

Because the first and the second jigs 70 and 80 have a total of eight suspending portions 73 and 83 which allow a total of eight reinforcing members 408 to be inserted through the eight suspending portions 73 and 83 in the inner hollow portion 403.

The number of the reinforcing members 408 depending on the diameter of the inner hollow portion 403, the degree required for reinforcement and the like. Hereinafter, the combination of the first and second jigs 70 and 80 is also referred to as "minasiki jig combination" and assigned to a reference numeral of 90.

Figure 21A:
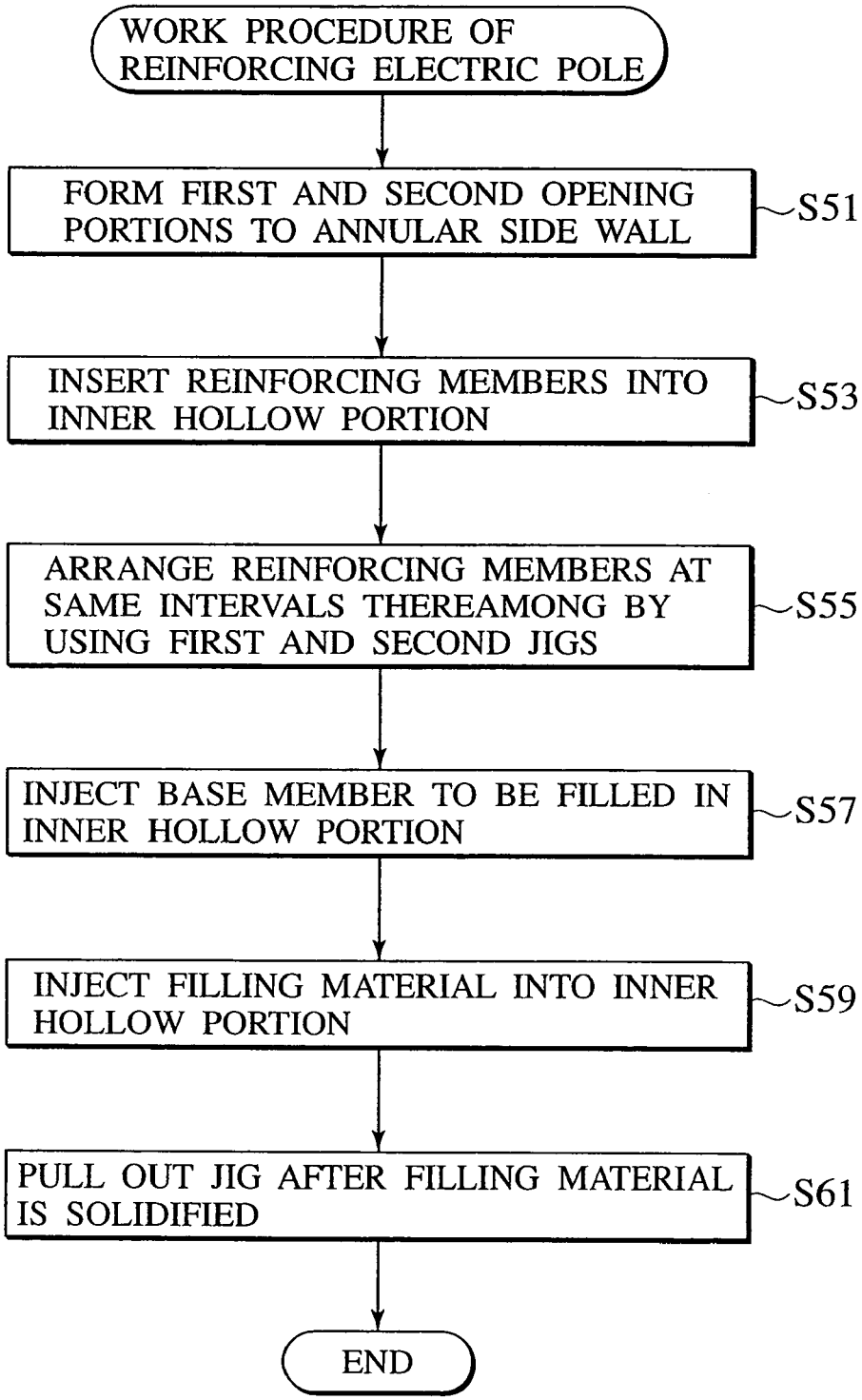
FIG. 21A is a flowchart showing a working procedure of reinforcing an electric pole which has not been reinforced yet according to the fourth embodiment.
Figure 21B:
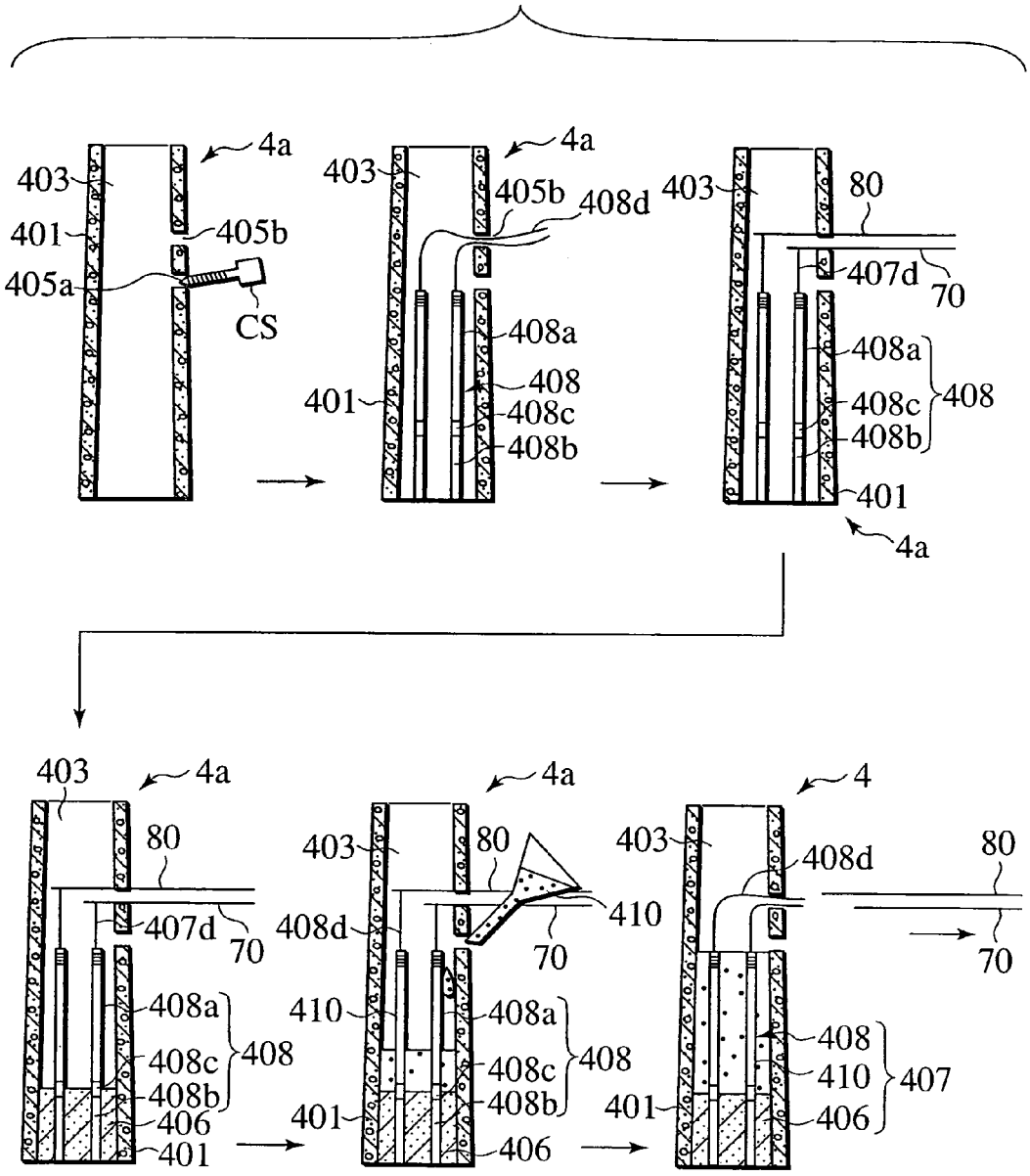
FIG. 21B is a view pictorially showing the working procedure shown in FIG. 21A.

FIG. 21A is a flowchart showing a working procedure of reinforcing the electric pole 4*a* which has not been reinforced yet according to the fourth embodiment. FIG. 21B pictorially shows the working procedure shown in FIG. 21A.

At first, suitable portions of the annular side wall 401 are drilled with the core sampling drill CS so that the first and second opening portions 405*a* and 405*b* are formed to the suitable portions of the annular side wall 401 (step S51).

Next, the reinforcing members 408 comprising the aramid rods 408*a* and the special reinforcements 408*b* connected thereto are prepared. The string members 408*d* are connected to the one end portions of the aramid rods 408*a*.

Then, the reinforcing members 408 are inserted from their lower end portions through the second opening portion 405*b* into the inner hollow portion 403 (step S53). In step S53, each other end portion of each of the string members 408*d* is pulled away through the second opening 405*b* from the inner hollow portion 403 to be exposed to the outside thereof.

Next, in step S55, the string members 408*d* are put from their other end portions through the through holes 73*a* and 83*a* of the first and second jigs 70 and 80, respectively.

Then, in step S55, the first and second jigs 70 and 80 are sequentially inserted from their lower end portions through the second opening portion 405*b* into the inner hollow portion 403 of the electric pole 4*a*.

Figure 22:
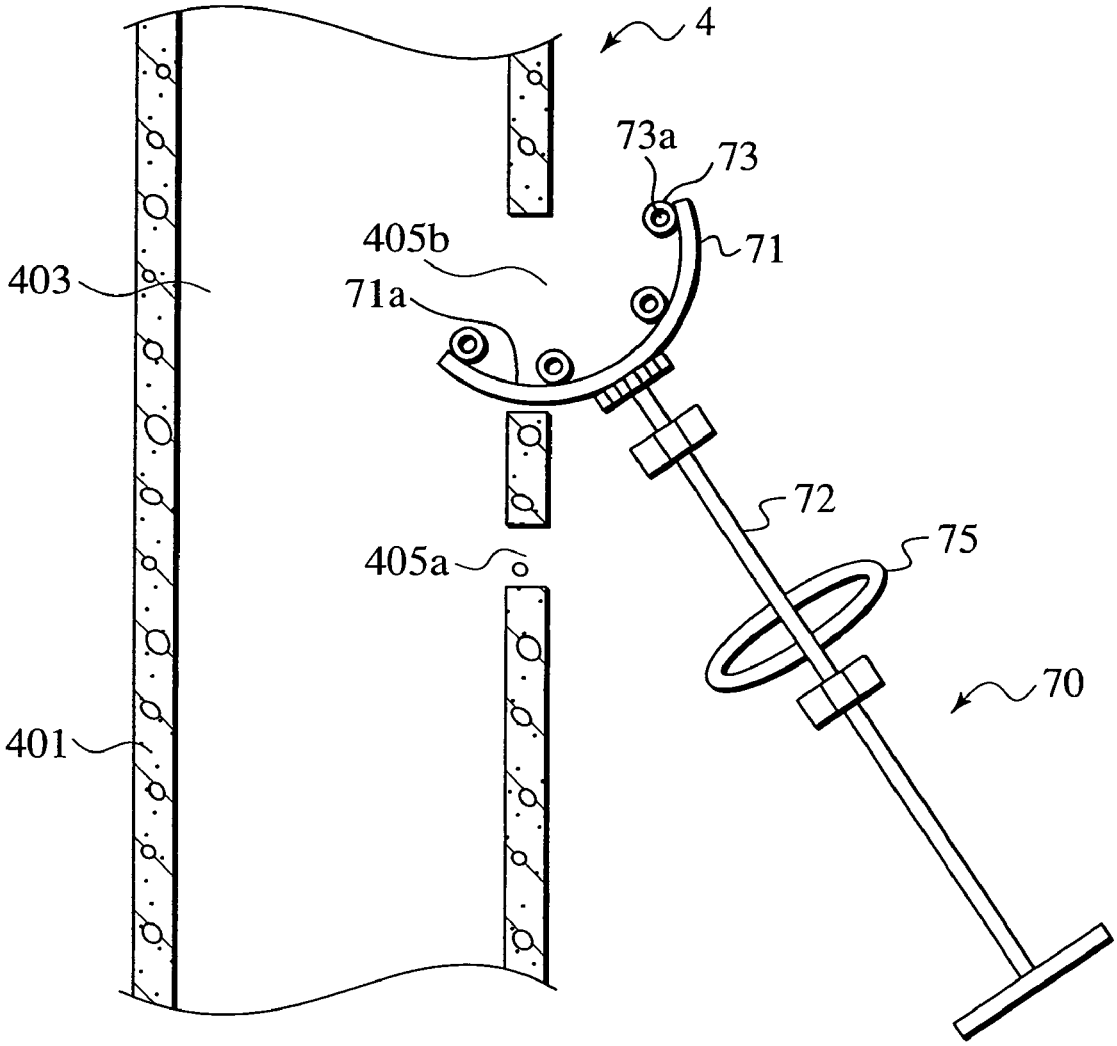
FIG. 22 is a view showing a state that the first jig is inserted into the electric pole shown in FIG. 18 according to the fourth embodiment.
Figure 23:
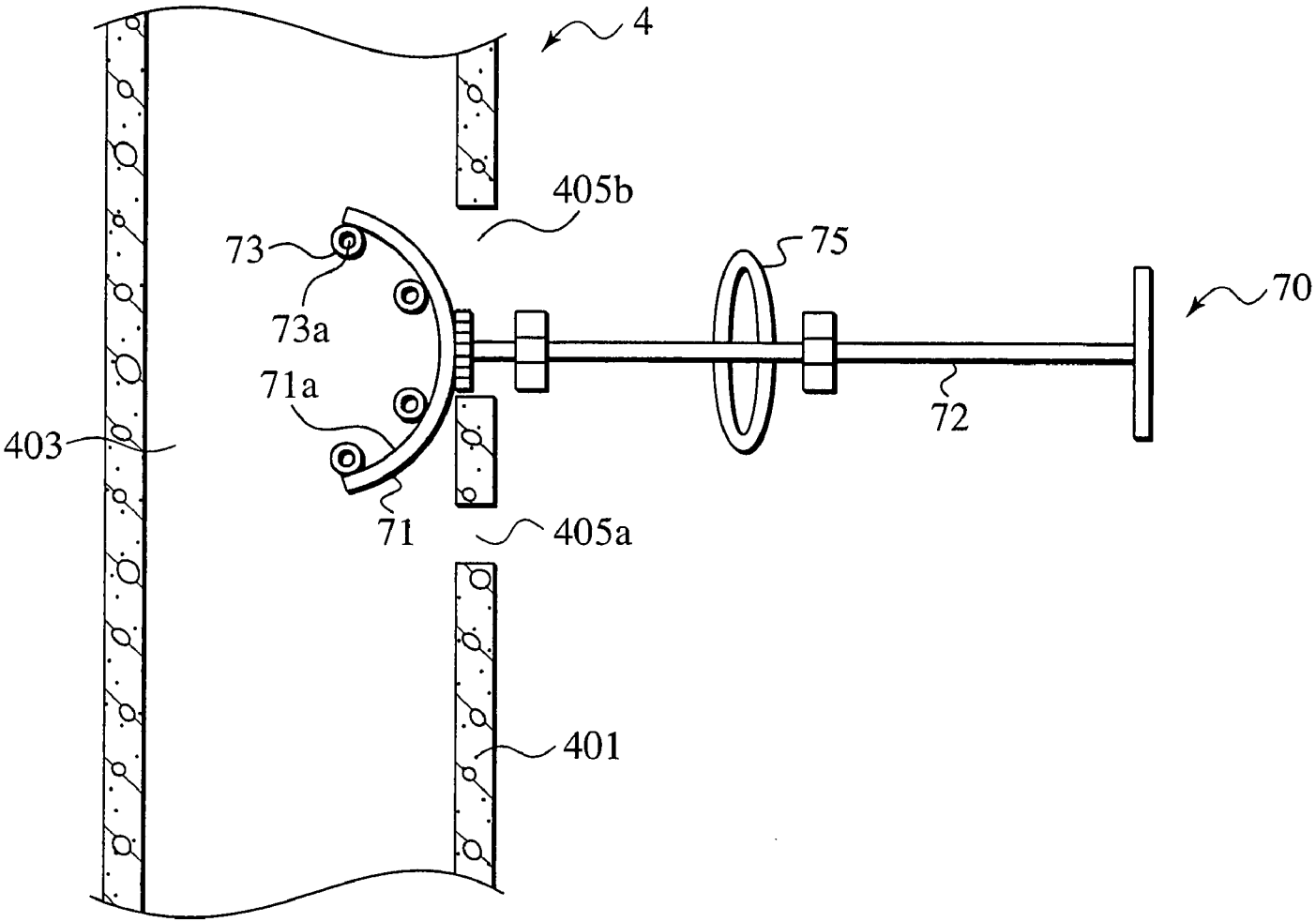
FIG. 23 is a view showing another state that the first jig is inserted into the electric pole shown in FIG. 18 according to the fourth embodiment.
Figure 24:
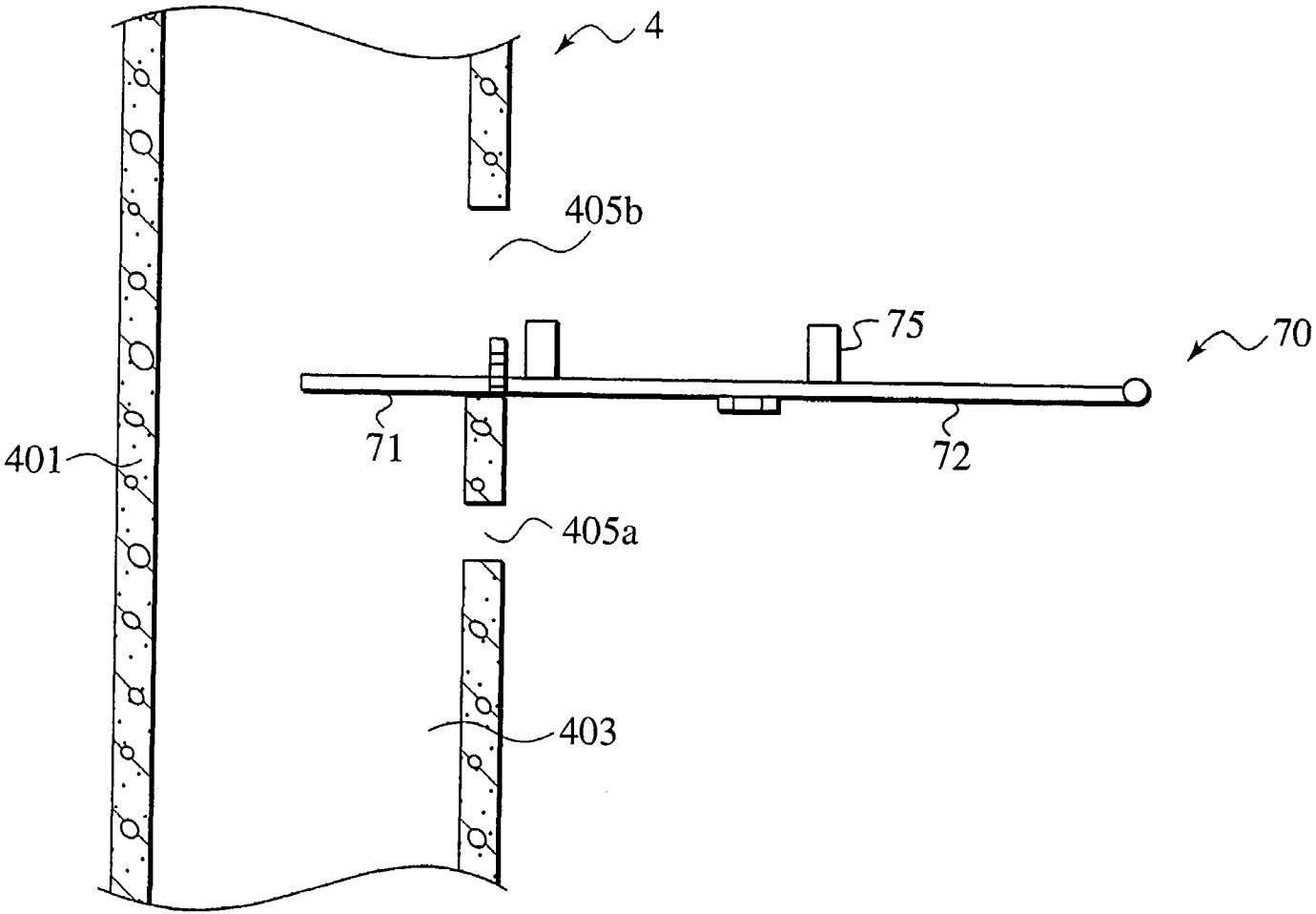
FIG. 24 is a view showing a final state that the first jig is inserted into the electric pole shown in FIG. 18 according to the fourth embodiment.

FIGS. 22 to 24 are views each explaining a procedure for inserting the first jig 70 into the inner hollow portion 403 of the electric pole 4*a*. Incidentally, in FIGS. 22 to 24, for focusing on the procedure for inserting the first jig 70, the reinforcing members 408 already inserted in the inner hollow portion 403 and the string members 408*d* are not shown.

At first, as shown in FIG. 22, the first supporting member 71 of the first jig 70 is inserted through the second opening portion 405*b* into the inner hollow portion 403 so that each axial direction of each through hole 73*a* of the first supporting member 71 is orthogonal to the axial direction (longitudinal direction) of the electric pole 4*a*.

When the length of the second opening portion 405*b* in the axial direction of the electric pole 4 is smaller than the arc length of the first supporting member 71, the first supporting member 71 is inserted with being rotated into the inner hollow portion 403.

FIG. 23 is a view showing a state that the base bar 72 of the first jig 70 is arranged in orthogonal to the axial direction and each axial direction of each through hole 73*a* is orthogonal to the axial direction of the electric pole 4*a*, too.

From the state of the first jig 70 shown in FIG. 23, the handled portion 75 of the first jig 70 is handled so that the first jig 70 is rotated around its an axial direction of the base bar 72 at an angle of 90° so that each axial direction of each through hole 73*a* is parallel to the longitudinal direction of the electric pole 4*a*, as shown in FIG. 24.

The state of the first jig 70 shown in FIG. 24, that is, the state that the first supporting member 71 is arranged in the inner housing portion 403 so that each axial direction of each through hole 73*a* is parallel to the longitudinal direction of the electric pole 4*a* allows the reinforcing members 408 to be arranged and fixed in the inner hollow portion 403, being referred to as "final state" hereinafter.

After the first jig 70 is made the final state, the second supporting member 81 of the second jig 80 is inserted through the second opening portion 405*b* into the inner hollow portion 403 while the first jig 70 is supported with its final state being kept.

Figure 25:
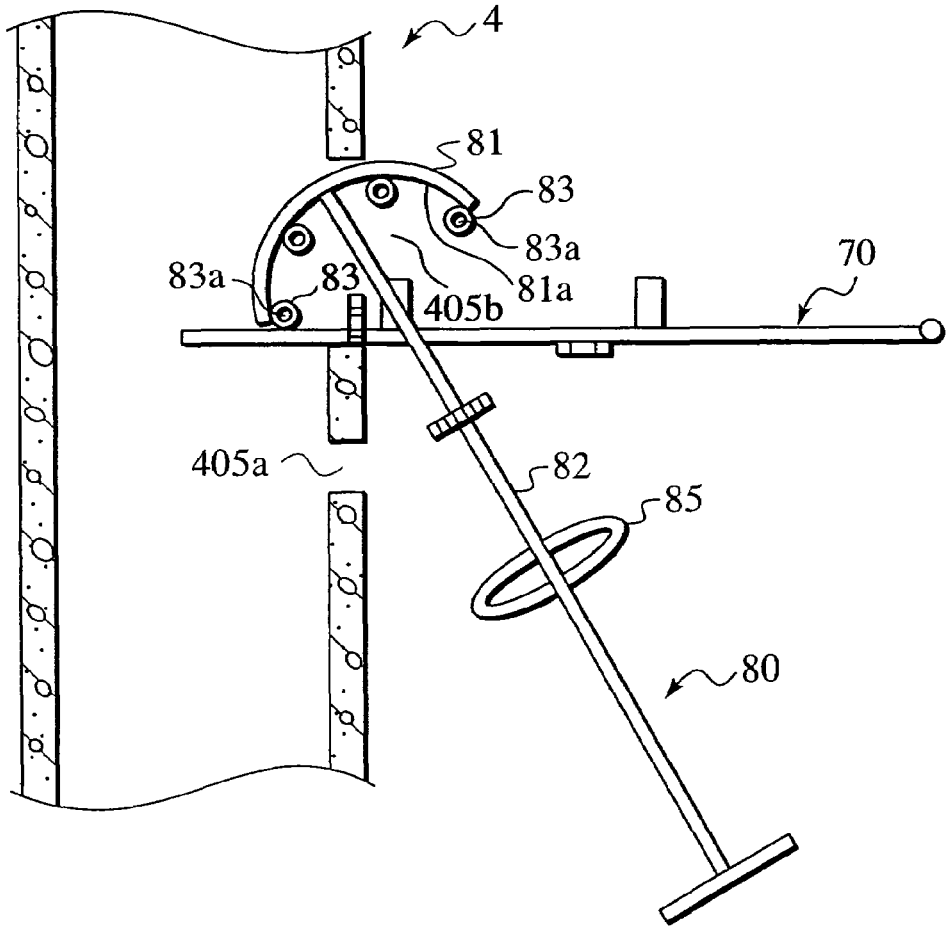
FIG. 25 is a view showing the first jig in the final state and the second jig is being inserted through a second opening portion into the inner hollow portion, respectively, according to the fourth embodiment.

FIG. 25 is a view showing the first jig 70 in the final state and the second supporting member 81 of the second jig 80 is being inserted through the second opening portion 405*b* into the inner hollow portion 403, respectively. Incidentally, insertion of the second supporting member 81 of the second jig 80 is carried out substantially similarly to the insertion of the first supporting member 71 of the first jig 70.

That is, as shown in FIG. 25, the second supporting member 81 is inserted with being rotated into the inner hollow portion 403 and the second supporting member 81 is arranged so that each axial direction of each through hole 83*a* is parallel to the longitudinal direction of the electric pole 4*a*. Incidentally, because the insertion of the second supporting member 81 into the inner hollow portion 403 is substantially the same as that of the first supporting member 71, omitting the detailed explanation of the insertion of the second supporting member 81.

Figure 26:
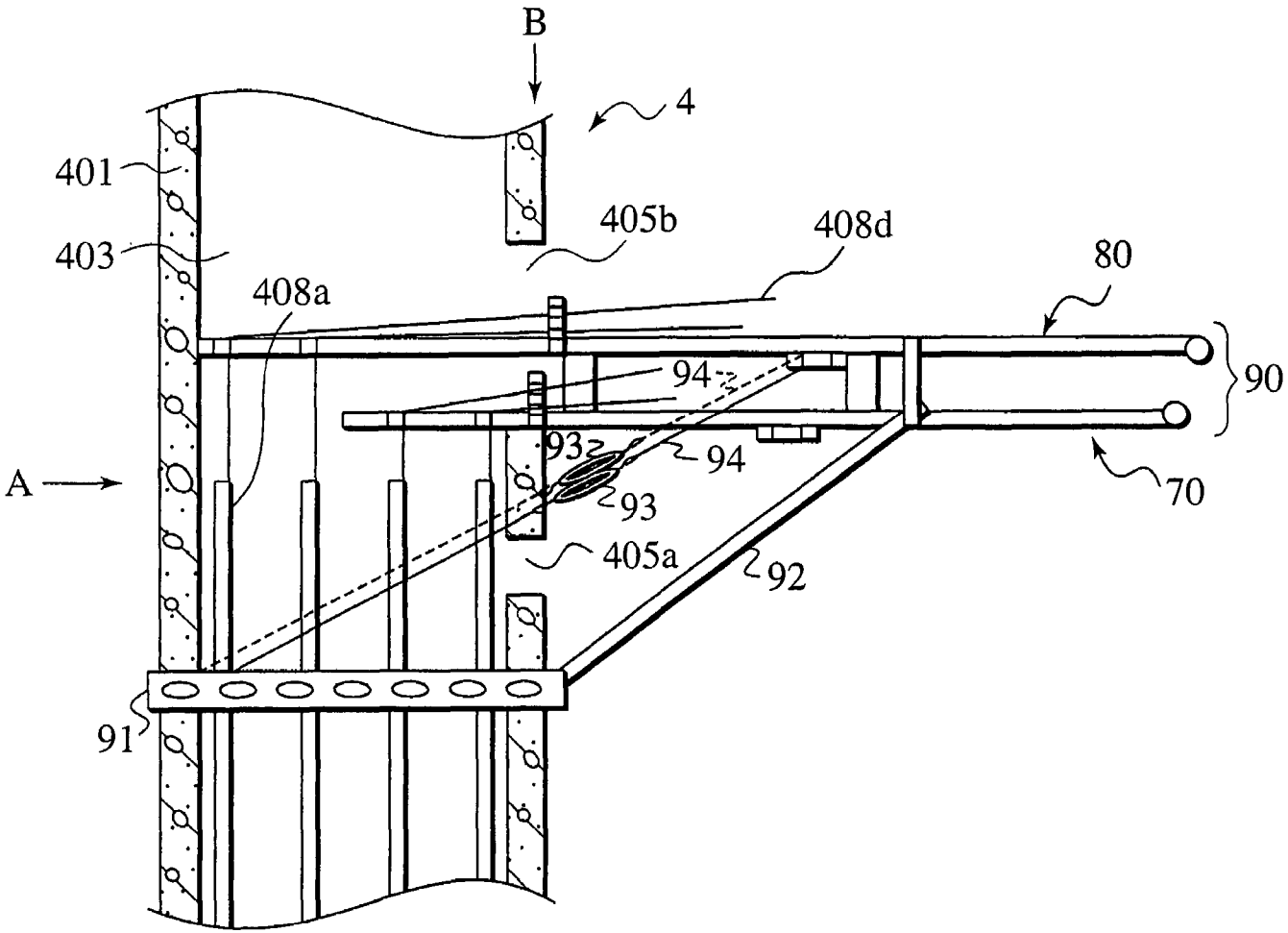
FIG. 26 is a view showing a minasiki jig combination comprising the first and second jigs which is already inserted in the inner hollow portion of the electric pole shown in FIG. 18 according to the fourth embodiment.

Then, FIG. 26 is a view showing the minasiki jig combination 90 comprising the first and second jigs 70 and 80 which are already inserted in the inner hollow portion 403 of the electric pole 4*a*.

That is, as shown in FIG. 26, the first and second supporting members 71 and 81 are parallely arranged at different heights. Namely, the second supporting member 81 is higher than the first supporting member 71.

In addition, as shown in FIG. 26, the minasiki jig combination 90 comprising the first and second jigs 70 and 80 is connected to a jig supporting member 91 winding around the outer periphery of the electric pole 4*a* by fixing members such as a band 92 and wires 94. Each wire 94 is provided at its middle portion with an adjusting element 93 for adjusting the length of the each wire 94. Incidentally, the wires 94 are shown by dashed line and solid line in FIG. 26, respectively, the former of which is positioned to a backside of the electric pole 4*a* in FIG. 26.

Figure 27:
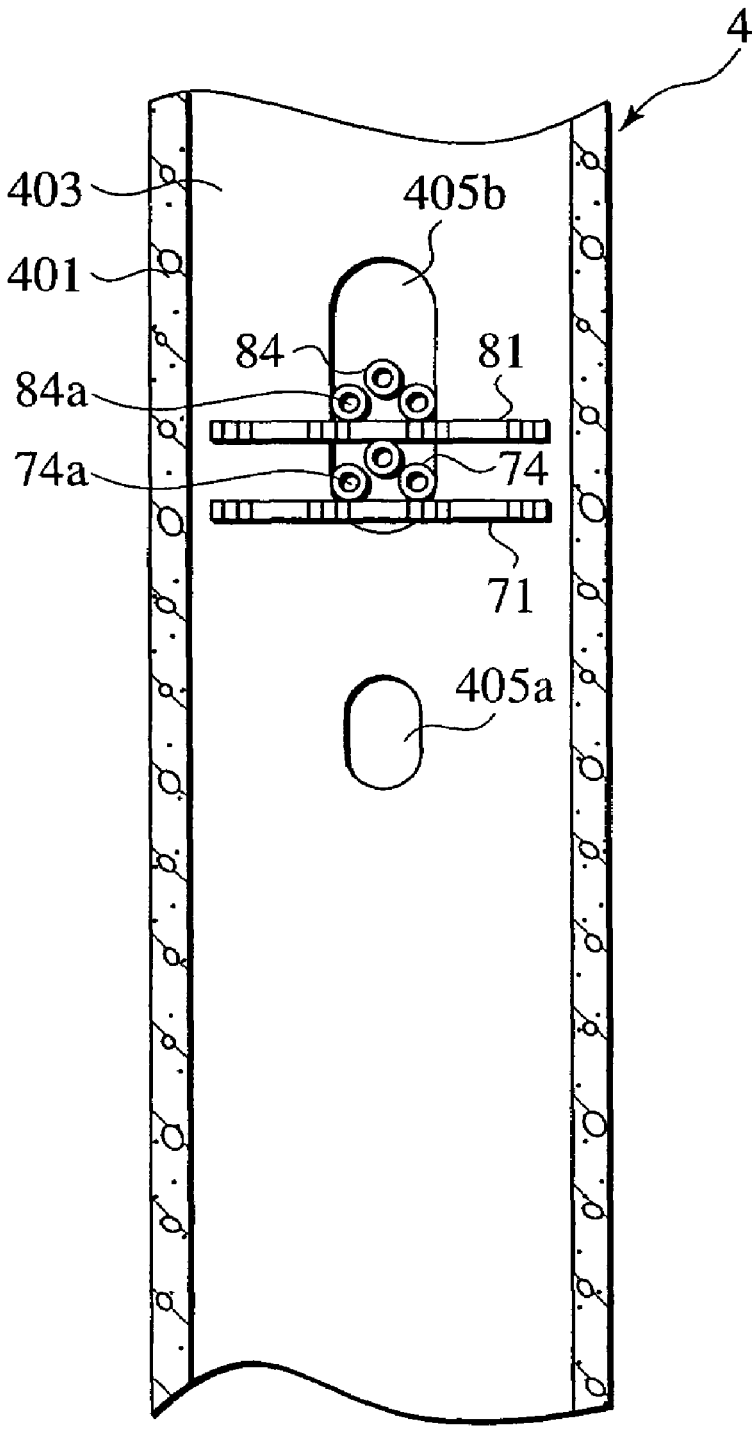
FIG. 27 is a view showing the minasiki jig combination in view of a direction indicated by an arrow "A" in FIG. 26 according to the fourth embodiment.
Figure 28:
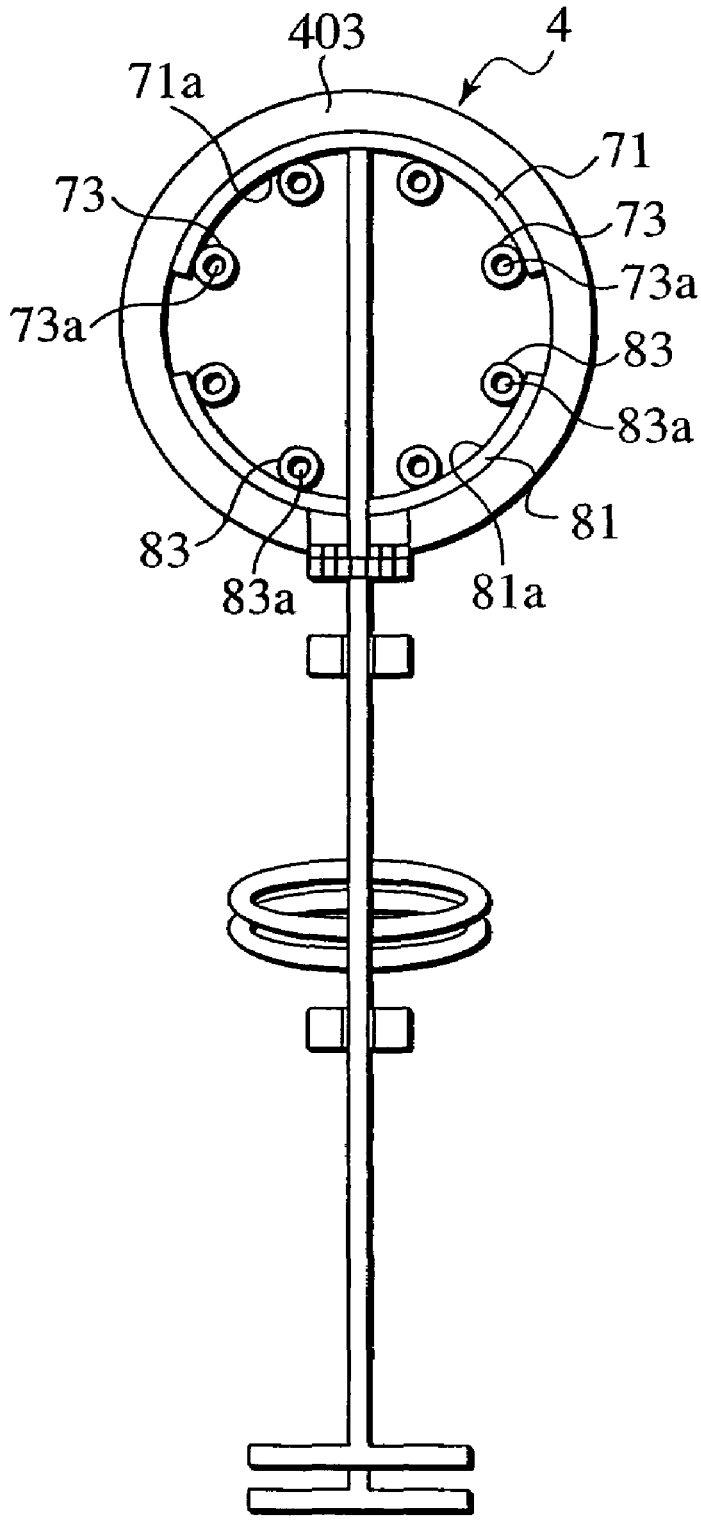
FIG. 28 is a view showing the minasiki jig combination in view of a direction indicated by an arrow "B" in FIG. 26 according to the fourth embodiment.

FIG. 27 is a view showing the minasiki jig combination 90 in view of the direction indicated by the arrow "A" in FIG. 26, and FIG. 28 is a view showing the minasiki jig combination 90 in view of the direction indicated by the arrow "B" in FIG. 26, that is, in view of the upper side of the minasiki jig combination 90. In each of FIGS. 27 and 28, only minasiki jig combination 90 is shown in order to simplify each of FIGS. 27 and 28.

As shown in FIG. 28, the whole shape of the combination of the first and the second supporting members 71 and 81 parallely arranged at different heights in view of an upper side of the combination appears to be substantially circular shape.

That is, when eight reinforcing members 408 are inserted in the inner hollow portion 403, as shown in FIG. 28, at least eight suspending portions 73 and 83 need to be mounted on the first and second supporting members 71 and 81 so that the suspending portions 73 and 83 (through holes 73*a* and 83*a*) are arranged at the same angle of substantially 45° thereamong in the circumferential direction and each axial direction of each through hole 73*a* and 83*a* is substantially parallel to the longitudinal direction.

Figure 29:
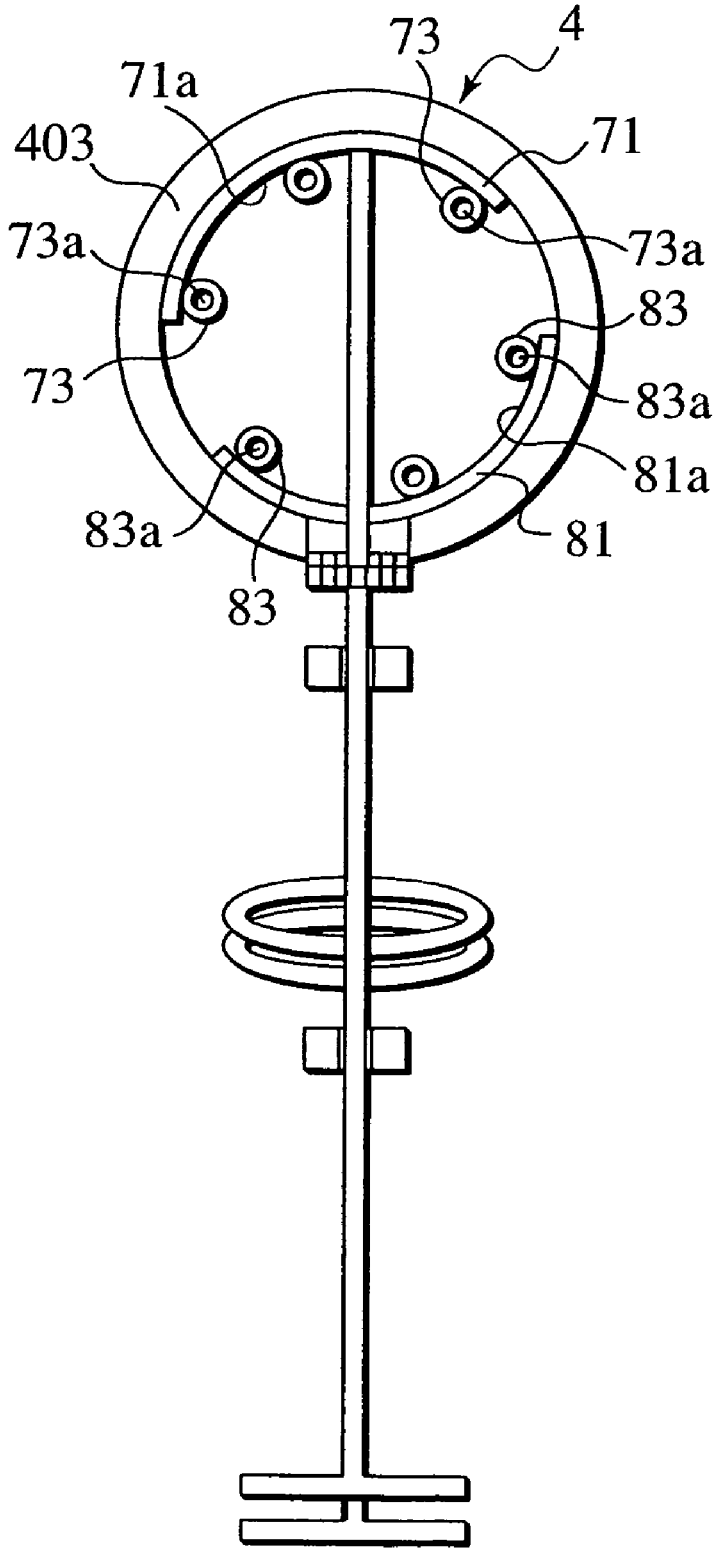
FIG. 29 is a view showing a modification of the minasiki jig combination in view of a direction indicated by an arrow "B" in FIG. 26 according to the fourth embodiment.

Incidentally, when six reinforcing members 408 are inserted in the inner hollow portion 403, at least six suspending portions 73 and 83 need to be mounted on the first and second supporting members 71 and 81 so that the suspending portions 73 and 83 (through holes 73*a* and 83*a*) are arranged at the same angle of substantially 60° thereamong in the circumferential direction and each axial direction of each through hole 73*a* and 83*a* is substantially parallel to the longitudinal direction, shown in FIG. 29.

Then, after fixedly supporting the minasiki jig combination 90 by the fixing members, in step S55, the exposed string members 408*d* out of the inner hollow portion 403 of the electric pole 4*a* through the second opening portion 405*b* are pulled away from the electric pole 4*a* so that the string members 408*d* get to be tensioned, causing the reinforcing members 408 to be suspended by the suspending portions 73 and 83 (through holes 73*a* and 83*a*), as shown in FIG. 26.

Because, in step S55, the suspending portions 73 and 83 (through holes 73*a* and 83*a*) are arranged at the same angle of substantially 60° that is the same intervals thereamong in the circumferential direction and each axial direction of each through hole 73*a* and 83*a* is substantially parallel to the longitudinal direction, the reinforcing members 408 connected to the tensioned string members 408*d* and supported by the suspending portions 73 and 83 are positioned at the same intervals in the circumferential direction, respectively, in the inner hollow portion 403.

After this work in step S55 such that all reinforcing members 408 are fixedly positioned at the same intervals thereamong in the circumferential direction, base members such as pieces of mortar, pieces of sand or pieces of gravel are injected from the first opening portion 405*a* to be filled in the inner hollow portion 403 of the lower portion of the pole 4*a* up to the height adjacent to the fixing members 408*c* of the reinforcing members 408, while the reinforcing members 408 are supported by the first and second jigs 70 and 80. The injected base members cause the base portion 406 in the inner hollow portion 403 of the electric pole 4*a* (step S57).

Next, the filling material 410 is injected from the first opening portion 405*a* into the inner hollow portion 403 up to the height adjacent to the top portions of the reinforcing members 408 (aramid rods 408*a*) while the reinforcing members 408 are supported by the first and second jigs 70 and 80 (step S59).

After the injected filling material 410 is solidified, the minasiki jig combination 90, that is, the first and second jigs 70 and 80 are pulled out of the inner hollow portion 403 (step S61). This pulling out step is carried out in the reverse procedure of inserting the first and the second supporting members 71 and 81 of the first and second jigs 70 and 80 into the inner hollow portion 403 of the electric pole 4*a*.

Incidentally, in step S61, the filling material 410 has some degree of viscosity, allowing the first and the second jigs 70 and 80 to be pulled out immediately after the work in step S59. After the work in step S61, parts of the string members 408*d* which are exposed out of the electric pole 4*a* are cut, and remained parts of which are inserted into the inner hollow portion 403 of the electric pole 4*a*.

In addition, when the filling material 410 is filled up to the vicinity of the first opening portion 405*a*, the injection of the filling material 410 may be once stopped so that the minasiki jig combination 90 is removed out of the inner hollow portion 403, and after that, the filling material 410 may be injected from the second opening portion 405*b* once again, whereby the reinforcing members 408 can be completely buried. In this case, because the filling material 410 is injected up to the height which is higher than the first opening portion 405*a*, the first opening portion 405*a* may be sealed by any one of sealing methods.

The above working procedure from step S51 to S61 are an example so that other procedures may be used in the range of the scope of the present invention.

Working procedure after step S61 is the same as the working procedure according to the third embodiment.

That is, the reinforcing work is carried out in accordance with the described procedure shown in FIG. 21A so that the reinforced electric pole 4 shown in FIG. 18 is accomplished.

Incidentally, after carrying out the work in step S61, in cases where it can be accepted to reinforce the reinforced electric pole 4 from the outer periphery thereof after sufficient consideration of constrains due to the installation requirements of the electric pole 4 and the reinforcing cost thereof, it may be possible to wind a seat member such as an aramid fiber seat or the like around an outer periphery of the annular side wall 401.

In addition, in cases where it is impossible to excavate the surface of the ground around the boundary portion of the concrete electric pole, a seat member such as an aramid fiber may be wound around only an outer periphery of a portion of the annular side wall 401, portion which ranges from the boundary portion of the electric pole 4 to the vicinity of the first opening portion and/or the second opening portion. This modification allows the strength of the electric pole to be more increased.

Furthermore, applicants performed bend test (JISA 5373) of the reinforced electric pole reinforced by using the above reinforcing method according to the fourth embodiment so that, in cases where the reinforced electric pole has 500 kg in weight, safety factor of substantially 2.3 to 2.6 was obtained, and in cases where the reinforced electric pole has 700 kg in weight, safety factor of substantially 2.1 to 2.4 was obtained. These safety factors exceed the standard safety factor of 2 naturally required for the strength of electric poles, showing that the reinforcing method according to the fourth embodiment can provide a sufficient strength to the reinforced electric poles.

The fourth embodiment of the present invention properly can obtain the same effects of the first, second and third embodiments.

In addition, in the fourth embodiment, the special reinforcements 408*b* connected to the aramid rods 408*a* allow the weights of the reinforcing members 408 themselves to be stable, preventing the reinforcing members 408 from being floated after the injection of the filling material 410, and increasing the reinforcing strength of the electric pole 4.

Furthermore, in the fourth embodiment, it is possible to provide the minasiki jig combination 90 comprising the first jig 70 and the second jig 80 which can stably support and fix the reinforcing members even if each of them has the special reinforcement and large weight.

The reinforcing method according to the fourth embodiment can be applied to reinforcing a middle portion of the electric pole in accordance with the aging change thereof due to transformers mounted on the upper portion of the electric pole and/or cables installed between the electric pole and another electric poles.

Incidentally, in each of the embodiments, the annular side wall of the electric pole may have a circular shape, an elliptic shape, a rectangular shape or the like in its lateral cross section.

While there has been described what is at present considered to be the preferred embodiments and modifications of the present invention, it will be understood that various modifications which are not described yet may be made therein, and it is intended to cover in the appended claims all such modifications as fall within the true spirit and scope of the invention.

The entire contents of Japanese Patent Application 2002-38252 filed on Feb. 15, 2002, Japanese Patent Application 2002-132022, and Japanese Patent Application 2002-204901 are incorporated herein by reference.

What is claimed is:

1. A jig for arranging a plurality of reinforcing members in an inner hollow portion of an existing concrete electric pole, each of said plurality of reinforcing members having one end portion to which a string member is connected, said jig comprising:

a base portion;

a plurality of supporting members rotatably mounted on one end portion of the base portion, said supporting members having a substantially rod shape and the same longitudinal length;

a plurality of handling arms configured to rotate the supporting members in a two-dimensional plane;

a through hole formed on both end portions of the supporting members, each of said through holes allowing each of said string members to be put therethrough; and a locking member mounted on the base portion, said locking member for releasable locking the supporting members.

2. A jig according to claim 1, wherein the plurality of supporting members are configured to be arranged at equally spaced intervals in a circular direction, said locking member releasable locking the supporting members when they are so spaced.

3. A method of arranging a plurality of reinforcing members in an inner hollow portion of an existing concrete electric pole by using the jig according to claim 1, each of said plurality of reinforcing members being inserted in the inner hollow portion and having one end portion to which a string member is connected, the method comprising the steps of:

connecting other end portions of the string members to the through holes of the jig, respectively, inserting the supporting members into the inner hollow portion through the opening portion;

rotating the supporting members so that the plurality of supporting members are arranged at equally spaced intervals in a circular direction, and releasable locking the supporting members with the locking member; and pulling the other end portions of the string members to tension so that the reinforcing members are arranged in the inner hollow portion at said equally spaced intervals in the circular direction.

4. A jig for arranging a plurality of reinforcing members in an inner hollow portion of an existing concrete pole, each of said plurality of reinforcing members has one end portion to which a string member is connected, said jig comprising:

a base bar;

a supporting member mounted on one end portion of the base bar, said supporting member having a surface of substantially circular arc shape; and a plurality of circularly shaped suspending members mounted on the inner surface of the arc-shaped supporting member so as to be arranged within the arc-shape, each of said suspending members having a through hole allowing the string member to be put therethrough.

5. A jig according to claim 4, wherein an axial direction of said through hole is orthogonal to a longitudinal direction of the base bar.

6. A jig according to claim 4, wherein said suspending members are arranged on the supporting member at equally spaced intervals in a circular direction of the surface of the supporting member.

7. A jig according to claim 4, wherein said inner surface of the arc-shaped supporting member faces away from the base bar.

8. A jig according to claim 4, wherein said inner surface of the arc-shaped supporting member faces toward the base bar.

9. A method of arranging a plurality of reinforcing members in an inner hollow portion of an existing concrete electric pole by using the jig according to claim 4, each of said plurality of reinforcing members being inserted in the inner hollow portion and having one end portion to which a string member is connected, the method comprising the steps of:

connecting other end portions of the string members to the through holes of the jig, respectively, inserting the supporting member into the inner hollow portion through the opening portion;

handling the jig so as to arrange the suspending members in such a way that an axial direction of each of the through holes is substantially parallel to the axial direction of the electric pole; and pulling the other end portions of the string members to tension so that the reinforcing members are arranged in the inner hollow portion at equally spaced intervals in a circular direction.

* * * * *